US006415723B1

(12) United States Patent
Kopish et al.

(10) Patent No.: US 6,415,723 B1
(45) Date of Patent: Jul. 9, 2002

(54) TRAINING TABLE WITH WIRE MANAGEMENT

(75) Inventors: Andrew J. Kopish; Timothy J. Bouche, both of Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/322,415

(22) Filed: May 28, 1999

(51) Int. Cl.[7] ..... A47B 3/02
(52) U.S. Cl. ..... 108/50.02; 108/128; 312/222.3; 312/223.6
(58) Field of Search ..... 108/50.01, 50.02, 108/64, 129, 130, 133; 312/194, 195, 223.3, 223.6

(56) References Cited

U.S. PATENT DOCUMENTS

| | | | |
|---|---|---|---|
| 127,484 | A | 6/1872 | Hirsh |
| 155,999 | A | 11/1874 | Valley |
| 165,951 | A | 7/1875 | Root |
| 290,932 | A | 12/1883 | Richardson |
| 1,177,639 | A | 4/1916 | Lessord |

(List continued on next page.)

FOREIGN PATENT DOCUMENTS

| | | |
|---|---|---|
| CA | 561882 | 8/1958 |
| CA | 754441 | 3/1967 |
| CH | 632654 | 10/1982 |
| DE | 212711 | 8/1909 |
| DE | 390509 | 2/1924 |

(List continued on next page.)

OTHER PUBLICATIONS

Falcon, M.A.T.S. Multiple Application Table System Catalog.
Falcon, M.A.T.S. Multiple Application Table System Brochure, 1996.

(List continued on next page.)

*Primary Examiner*—Jose V. Chen
*Assistant Examiner*—Michael J. Fisher
(74) *Attorney, Agent, or Firm*—Andrus, Sceales, Starke & Sawall, LLP

(57) ABSTRACT

A folding table or desk includes a table top, a pair of spaced apart legs, and a wire management structure pivotably mounted to the table top and located between the legs. The wire management structure includes a front panel assembly having an opening, and an access member is pivotably mounted to the front panel assembly for movement between an open position, a closed position and a collapsed position. The front panel assembly can be folded against the underside of the table top and the access member can be pivoted to its collapsed position relative to the front panel assembly, and the legs are foldable over the wire management structure to provide a compact envelope for the folded components of the table assembly. The front panel assembly includes a cross brace member which is engageable with the legs when the wire management structure is in its operative extended position, to impart rigidity to the table assembly. Wires or cables are fed through openings in the table top into an internal cavity defined by the wire management structure, for engagement with power or communication receptacles located within the internal cavity. Equipment may also be supported by the underside of the table top, and wires or cables from such equipment can be fed through the opening in the front panel assembly into the internal cavity of the wire management structure. A latch arrangement is carried by the table assembly for enabling adjacent table assemblies to be ganged together.

58 Claims, 11 Drawing Sheets

U.S. PATENT DOCUMENTS

| | | | |
|---|---|---|---|
| 1,903,954 | A | 4/1933 | Blumenthal |
| 2,509,546 | A | 5/1950 | Welk et al. |
| 3,643,907 | A | 2/1972 | Ham |
| 3,805,711 | A | 4/1974 | Lakso |
| 3,991,687 | A | 11/1976 | Burr |
| 3,993,005 | A | 11/1976 | Burr |
| 4,010,699 | A | 3/1977 | Lakso |
| 4,214,725 | A | 7/1980 | Eberle |
| D261,341 | S | 10/1981 | Eberle |
| D263,189 | S | 3/1982 | Beals |
| 4,444,124 | A | 4/1984 | Burr |
| 4,789,122 | A | 12/1988 | Gutgsell |
| 4,827,850 | A | 5/1989 | Diffrient |
| 4,827,851 | A | 5/1989 | Diffrient |
| 4,838,180 | A | 6/1989 | Gutgsell |
| 4,875,418 | A | 10/1989 | Moeckl et al. |
| 4,986,195 | A | 1/1991 | Diffrient |
| D314,299 | S | 2/1991 | Diffrient |
| D322,373 | S | 12/1991 | Gutgsell |
| D322,729 | S | 12/1991 | Diffrient |
| D324,615 | S | 3/1992 | Diffrient |
| D329,554 | S | 9/1992 | Diffrient |
| 5,144,896 | A | 9/1992 | Fortsch |
| D333,058 | S | 2/1993 | Diffrent |
| D335,983 | S | 6/1993 | Gutgsell |
| 5,279,233 | A | 1/1994 | Cox |
| 5,337,657 | A | 8/1994 | Diffrient |
| 5,345,881 | A | 9/1994 | Loescher |
| 5,354,027 | A | 10/1994 | Cox |
| 5,365,861 | A | 11/1994 | Gutgsell |
| D355,317 | S | 2/1995 | Gutgsell |
| 5,390,610 | A | 2/1995 | Gutgsell |
| 5,427,341 | A | 6/1995 | Gutgsell |
| D360,325 | S | 7/1995 | Gutgsell |
| 5,490,467 | A | 2/1996 | Diffrient |
| 5,507,204 | A | 4/1996 | Diffrient |
| 5,533,457 | A | 7/1996 | Cox |
| D372,812 | S | 8/1996 | Graziano et al. |
| 5,560,302 | A | 10/1996 | Diffrient et al. |
| 5,568,773 | A | 10/1996 | Hung |
| 5,640,912 | A | 6/1997 | Diffrient |
| 5,715,760 | A | 2/1998 | Frascaroli et al. |
| D391,841 | S | 3/1998 | Loescher |
| 5,749,121 | A | 5/1998 | Loescher |
| 5,752,449 | A | 5/1998 | Simon et al. |

FOREIGN PATENT DOCUMENTS

| | | |
|---|---|---|
| DE | 161012 | 6/1933 |
| DE | 16493 | 3/1989 |
| EP | 0131673 | 10/1987 |
| EP | 0572770 | 6/1992 |
| FR | 393495 | 12/1908 |
| FR | 1004929 | 4/1952 |
| FR | 2624176 | 6/1989 |
| GB | 14530 | of 1894 |
| GB | 483470 | 4/1938 |
| GB | 2207601 | 7/1997 |
| IT | 356303 | 9/1937 |
| WO | WO90/03132 | 4/1990 |

OTHER PUBLICATIONS

Bretford, Folding Training Tables Catalog.
Bretford, Fixed Leg Training Tables Catalog.
Bretford, Transtable Brochure, 1996.
Howe, Tutor Traning Tables Brochure.
"Folding Tables", Contract Design Magazine, pp. 48–50, Sep. 1995.
Howe, Tutor Systems Furniture Catalog, pp. 205–231.
Bretford Power Systems 101 Brochure.
Bretford Presentation Environments Price List, Jan. 1, 1998.
Vecta Table Cable Installation Instructions.
Vecta Table Cable Brochure.
Versteel Powerlink Catalog.

FIG. 1
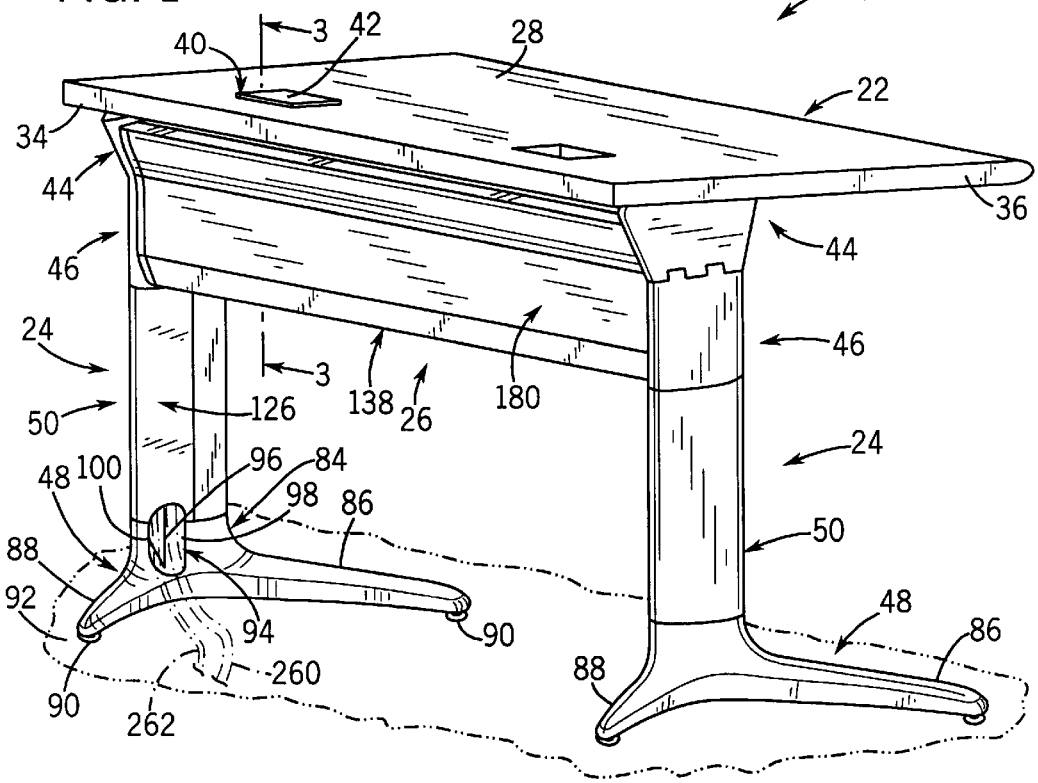
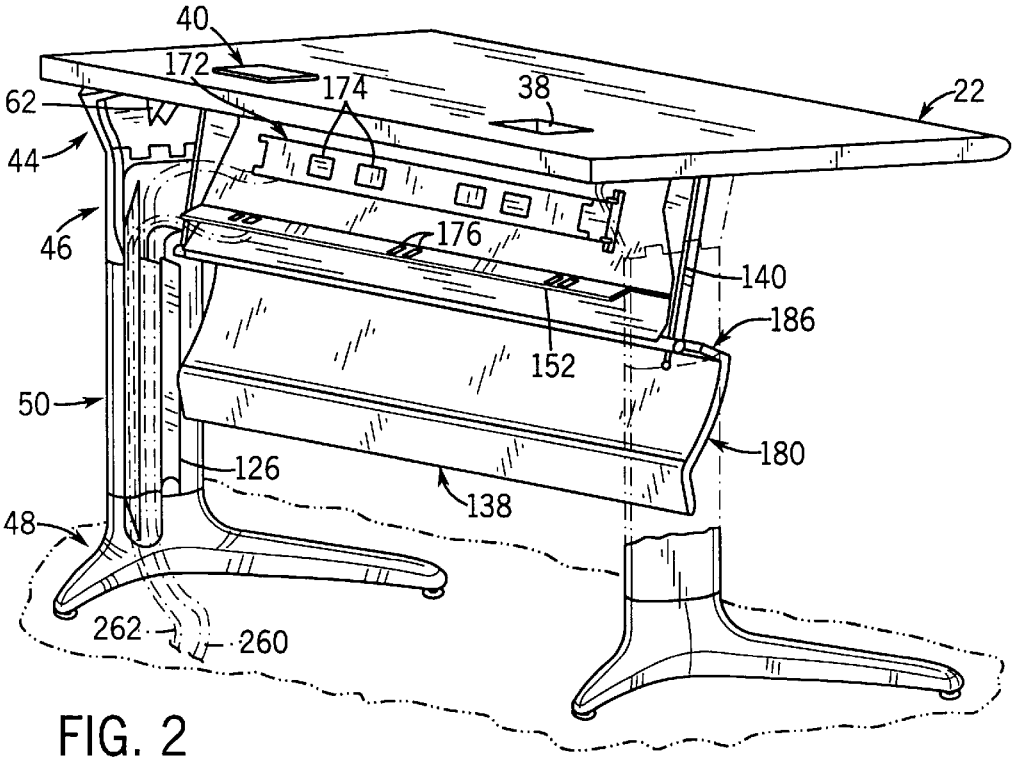
FIG. 2

FIG. 15
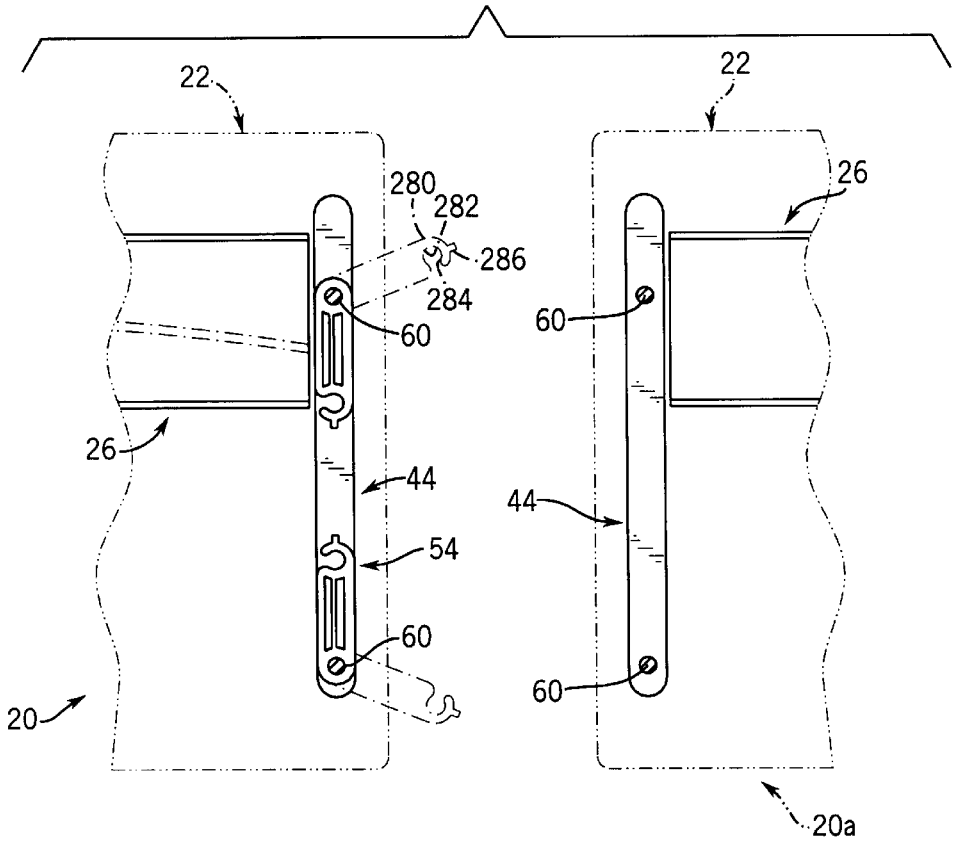
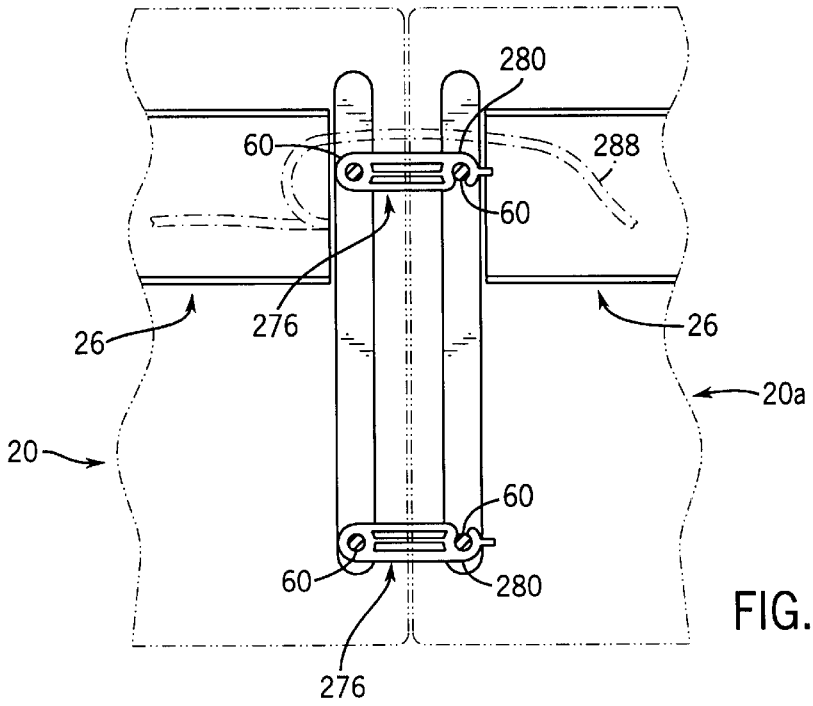
FIG. 16

TRAINING TABLE WITH WIRE MANAGEMENT

BACKGROUND AND SUMMARY OF THE INVENTION

This invention pertains to a table assembly, and more particularly to a table assembly incorporating a foldable leg arrangement and including a wire management arrangement for accommodating wires and cables associated with equipment supported on a table top forming a part of the table assembly.

In applications in which electrified equipment is supported on a table top, it is known to provide a housing below the table top for accommodating cables or wires associated with equipment supported on the table top, and for mounting electrical and/or data receptacles for providing power and communication to connectors associated with such cables or wires. One such structure is shown in co-pending application Ser. No. 08/258,429 filed Jun. 10, 1994, the disclosure of which is hereby incorporated by reference. This application discloses a table or desk top having a power and communication housing fixedly mounted to its underside. Cables or wires extend through one or more openings in the table or desk top, and a movable cover is selectively engageable with the table or desk top for providing access to such wires or cables for connection to power and communication receptacles interconnected with the power and communication housing. The power and communication housing extends between a pair of fixed legs which are mounted to the table or desk top for supporting the table or desk top above a supporting surface such as a floor. While this type of table or desk structure functions extremely well in permanent installations, it is not well suited for installations in which folding of the table or desk is required for accommodating movement of the table or desk from one location to another and/or storage of the table or desk.

A folding table or desk is disclosed in Diffrient U.S. Pat. No. 5,337,657, which shows a wire management housing to which of the table or desk top is pivotably mounted for movement between an operative horizontal position and an inoperative folded position. The wire management housing is located between a pair of spaced legs, and each leg is pivotably mounted to an end of the wire management housing for movement about a vertical pivot axis between an operative position and a folded position. The legs are oriented such that when the table top is folded downwardly, the lower ends of the legs extend below the lower edge of the table top. While this table or desk is usable in installations requiring folding of the table components for movement or storage, the extension of the legs beyond the lower edge of the table top takes up an excessive amount of storage space. Further, the table cannot support itself when folded, and thus must be engaged with a supporting structure such as a wall or the like to prevent the folded table from tipping over.

It is an object of the present invention to provide a folding table assembly which incorporates a table top, a folding leg arrangement mounted to the table top, and a wire management structure, which is well suited for receiving cables or wires and which provides components which fold to a compact condition for movement and storage of the table assembly. It is a further object of the invention to provide such a table assembly in which the wire management structure functions to impart rigidity to the leg structure when the leg structure is in an operative extended position. A further object of the invention is to provide such a table assembly in which the wire management structure is adapted to be folded against the underside of the table top when not in use, and in which the legs are foldable over the wire management structure. A still further object of the invention is to provide such a table assembly which is capable of supporting itself on a supporting surface, such as a floor, when the components of the table assembly are in a folded position. Yet another object of the invention is to provide such a table assembly having legs which are capable of receiving wires or cables and which accommodate passage of wires or cables into an internal cavity defined by the wire management structure. Yet another object of the invention is to provide such a table assembly in which wires or cables can be positioned within a recess in each leg and placed within the internal cavity of the wire management structure without having to thread wires or cables through a passage in either the legs or the wire management structure. Yet another object of the invention is to provide such a table assembly which is relatively simple in its components and manufacture, yet which provides highly satisfactory accommodation of wires or cables and movement of its components between folded and unfolded positions.

The invention generally includes a table top defining an upper surface and an underside, in combination with leg structure and a wire management housing or structure mounted to the underside of the table top. The leg structure is preferably in the form of a pair of spaced apart legs, each of which is pivotable toward each other to an inoperative folded position and away from each other toward an operative extended position. The wire management structure is mounted to the underside of the table top between the pair of legs, and is pivotable between an operative extended position and an inoperative folded position against the underside of the table top.

Each leg includes a wire management recess extending throughout at least a portion of its length, and a cover is movably mounted adjacent the recess for movement between an open position and a closed position. The wire management structure includes an access member movable between an open position and a closed position for selectively providing access to an internal cavity defined by the wire management structure and selectively preventing access to the internal cavity. The legs and the wire management structure are oriented relative to each other such that the access member and the cover can each be in its open position at the same time. In this manner, wires or cables can be laid into the wire management recess in the leg and into the internal cavity of the wire management structure without having to thread such wires or cables into or through passages. When wires or cables are positioned in this manner within the wire management recess of the leg and the internal cavity of the wire management structure, the cover and the access member can subsequently be closed to maintain the wires or cables within the wire management recess and the internal cavity.

In accordance with another aspect of the invention, the wire management structure includes a front panel assembly movably mounted to the underside of the table top. A pivot connection is provided between the front panel assembly and the table top, for providing movement of the wire management structure between its operative extended position and its inoperative folded position. A cross brace member is mounted to the panel member at a location spaced from the pivot connection. The cross brace member is releasably engageable with the legs when the legs are in their operative extended positions, for bracing the legs against lateral movement and for preventing movement of each leg toward its inoperative folded position. The cross brace member braces the legs against lateral movement and imparts rigidity to the overall structure of the table assembly. The cross brace member includes a pair of spaced ends, and an extendible and retractable engagement member is mounted to each end of the cross brace member for engagement within a recess associated with one of the legs when the wire management structure and the legs are in their operative extended positions. The extendible and retractable engagement member is disengageable from the recess for enabling the wire management structure and the legs to be moved to their inoperative folded positions. The access member is movable between its open and closed positions by means of a pivot connection interposed between the access member and the cross brace member.

In accordance with another aspect of the invention, the movable access member is capable of movement between an open position and a closed position when the wire management structure is in its operative extended position, and is movable to a collapsed position when the wire management structure is in its inoperative folded position. In this manner, the access member provides selective access to the internal cavity of the wire management structure when the wire management structure is in its operative extended position, and movement of the access member to its collapsed position functions to reduce the volume of space occupied by the wire management structure when the wire management structure is in its inoperative folded position. The legs are foldable over the wire management structure when the access member is in its collapsed position, and the collapsibility of the wire management structure functions to reduce the overall space requirements for the legs and wire management structure when in their inoperative folded positions, to provide a compact overall package for the folded table assembly for providing ease of movement and storage. The access member is preferably pivotably mounted to the cross brace member, and engagement structure is interposed between the access member and the cross brace member for releasably maintaining the access member in its closed position and for accommodating movement of the access member to its open position and to its collapsed position.

In accordance with another aspect of the invention, an opening is formed in the panel member for providing access to the internal cavity of the wire management structure other than through the access member. The wire management structure is preferably oriented relative to the table top so as to provide access to the internal cavity from the rear of the table top when the access member is in its open position. The opening in the panel member is preferably oriented so as to provide access to the internal cavity from the front of the table top. In this manner, wires or cables from a device, such as a CPU, mounted to the underside of the table top can be fed directly through the opening into the internal cavity. A cover is preferably mounted to the panel member and extends over the opening for covering the opening. In a preferred form, the cover is in the form of a resilient closure wall or flap which is deflectable to enable wires or cables to be passed through the opening. The closure wall or flap is deformable over the wires or cables to close the opening around the wires or cables. The opening may extend throughout the entire length of the wire management structure for accommodating wires or cables at any location along the width of the table top, and the cover likewise extends throughout the entire length of the opening.

In accordance with another aspect of the invention, a ganging arrangement is provided for releasably engaging first and second adjacent table assemblies with each other. Each table assembly includes a table top and a pair of legs, and each leg defines an upper end, at least a portion of which is spaced below the underside of the table top. The table top of the first table assembly includes a stationary engagement member located within the space between the underside of the table top and the upper surface of the leg. The second table assembly includes a movable latch member which is located below the underside of the table top of the second table assembly and which is nonremovably mounted for movement between an inoperative storage position and an operative latching position. The latch member is preferably mounted for pivoting movement between its inoperative storage position and its operative latching position, and is disposed within a space between the underside of the table top and an upper surface of the leg of the second table assembly. In a preferred form, the first table assembly includes a pair of engagement members and the second table assembly includes a pair of latch members, each of which is engageable with one of the engagement members of the first table assembly. The latch members are movable into the space between the underside of the table top and the upper surface defined by the leg when in their inoperative storage positions, for concealing the latch members when not in use. Each latch member preferably defines an inner end having a closed passage and an outer end defining an open recess. A boss is located between the underside of the table top and the upper surface of the leg, and extends through the closed passage in the inner end of the latch member for providing pivoting movement of the latch member between its inoperative storage position and its operative latching position. A similar boss arrangement is provided for the first table assembly and defines the engagement members of the first table assembly.

The various features and aspects of the invention may be employed separately, and each provides advantages in construction, assembly or use of a table assembly or components of a table assembly. Alternatively, the features and aspects of the invention may be used in various subcombinations or all together, for providing additional enhancements and advantages in construction, assembly or use of a table assembly.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a table assembly constructed according to the invention, incorporating a table top, a pair of foldable legs and a wire management structure extending between the pair of legs;

FIG. 2 is a view similar to FIG. 1, showing an access member of the wire management structure movable to an open position;

FIG. 15 is a schematic partial top plan view of a pair of table assemblies of FIG. 1 moved apart from each other;

FIG. 16 is a view similar to FIG. 15, showing use of the latch members of FIG. 14 for securing a pair of adjacent table assemblies together;

DETAILED DESCRIPTION OF THE INVENTION

Figure 3:
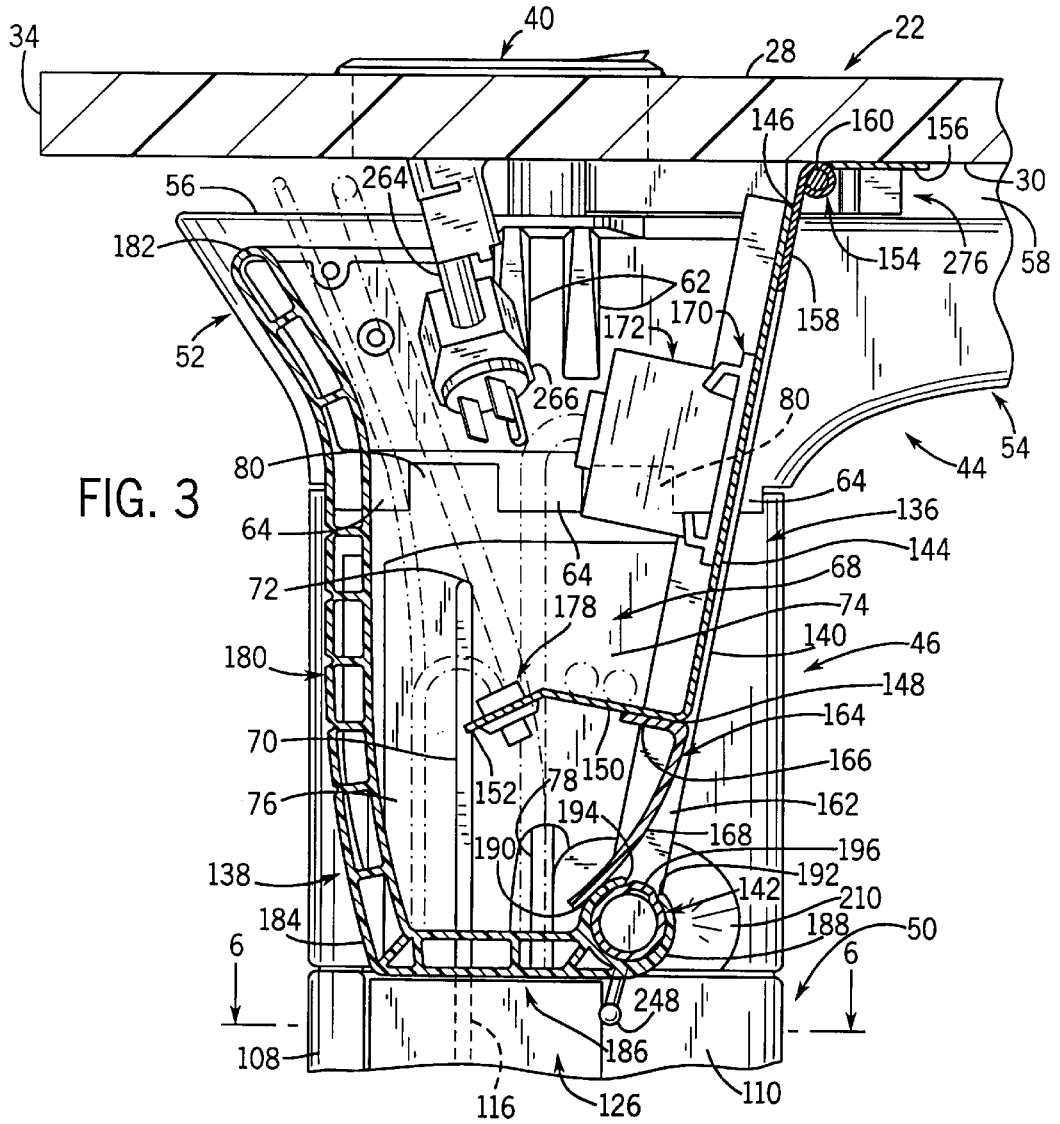
FIG. 3 is a partial section view taken along line 3—3 of FIG. 1.

Referring to FIG. 1, a table assembly 20 constructed according to the present invention generally includes a table top 22, a pair of mirror image foldable leg assemblies 24, and a wire management housing or structure 26 located between leg assemblies 24.

Referring to FIGS. 1–4, table top 22 includes an upper surface 28, an underside 30, front and rear edges 32, 34, respectively, and side edges 36 which extend between front and rear edges 32, 34, respectively. A pair of spaced openings 38 are formed in table top 22 toward its rear edge 34, extending between upper surface 28 and underside 30 of table top 22. A grommet assembly 40, including a movable cover 42, is mounted within each opening 38. Openings 38 and grommet assemblies 40 provide a passage through table top 22.

Each leg assembly 24 includes an upper stationary mounting section 44, a shoulder section 46, a foot 48 and an intermediate section 50 interposed between the lower end of shoulder section 46 and the upper end of foot 48.

Figure 12:
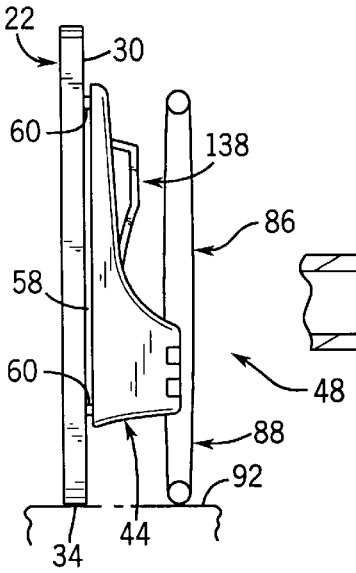
FIG. 12 is an end elevation view of the folded table assembly of FIG. 11.

Upper mounting section 44 of each leg assembly 24 includes a rear section 52 and a forwardly extending arm 54 which define a coplanar upper surface 56 which is spaced below underside 30 of table top 22 so as to define a gap or space 58. Referring to FIG. 12, a pair of mounting bosses 60 extend between upper surface 56 and underside 30 of table top 22. Mounting bosses 60 are formed integrally with mounting section 44, and table top 22 engages the upper ends of mounting bosses 60. Each mounting boss 60 defines a passage, and a threaded fastener extends through the passage in each mounting boss 60 into engagement table top 22 for securing table top 22 to leg mounting section 44.

As shown in FIGS. 1–4, mounting section 44 is formed with a pair of reinforcing ribs 62 located below each mounting boss 60. A series of hinge knuckles 64 are formed at the lower end of rear section 52 of leg mounting section 44. Each hinge knuckle 64 defines an aligned horizontal passage, in a manner as is known. Mounting section 44 may be a cast metal member formed of a material such as aluminum, and the horizontal passages in hinge knuckles 64 are machined after casting to provide a smooth internal surface.

Shoulder section 46 of leg assembly 24 is formed with a recess 68 within which an axially extending separator wall 70 is formed. Separator wall 70 defines an upper end 72, and divides recess 68 into a front recessed area 74 and a rear recessed area 76. A reinforcing rib 78 is formed in recess 68 toward the lower end of shoulder section 46. A pair of hinge knuckles 80 are formed at the upper end of shoulder section 46, and are located in the spaces between hinge knuckles 64 of upper mounting section 44. Hinge knuckles 80 include horizontal passages in alignment with the horizontal passages of hinge knuckles 64, and a hinge pin extends into and through the aligned horizontal passages in hinge knuckles 64, 80 for providing pivoting movement of shoulder section 64 about a horizontal pivot axis parallel to and spaced below table top 22. Shoulder section 46 is preferably a cast metal member formed of a material such as aluminum, and again the passages in hinge knuckles 80 are machined after casting to provide a smooth internal surface.

Foot 48 of each leg assembly 24 includes a base section 84, a forward extension 86 which extends forwardly from base section 84 and a rearward extension 88 which extends rearwardly from base section 84. A glide 90 is mounted to the underside of the front end of forward extension 86. Similarly, a glide 90 is mounted to the underside of the rear end of rearward extension 88. Glides 90 engage a supporting surface 92, such as a floor, for spacing table top 22 above supporting surface 92. A recess 94 is formed in the inner surface of base section 84. An axial separating wall 96 is located within recess 94, and functions to divide recess 94 into a front recessed area 98 and a rear recessed area 100. Foot 48 is preferably a cast metal member formed of a material such as aluminum.

Figure 6:
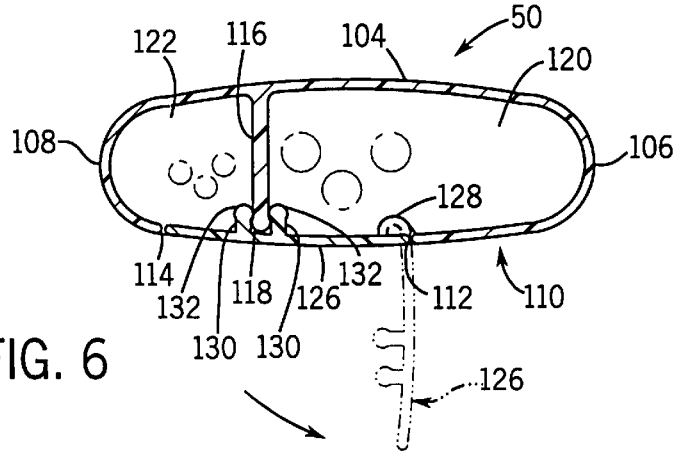
FIG. 6 is a section view taken along line 6—6 of FIG. 3.

Referring to FIG. 6, intermediate section 50 of each leg assembly 24 includes an outer wall 104 which extends between an arcuate front wall 106 and an arcuate rear wall 108. Front wall 106 merges with a partial inner wall 110 which terminates in a rearward end 112. Rear wall 108 terminates in a forward end 114 spaced rearwardly from rearward end 112 of partial inner wall 110. An axial divider 116 extends inwardly from the inner surface of outer wall 104, and terminates in an inner end 118 which forms an engagement bead having a diameter slightly greater than the width of divider 116. Intermediate section 50 defines a front passage 120 and a rear passage 122 separated by divider 116. The open area between inner wall rearward end 112 and forward end 114 of rear wall 108 provides access to front and rear passages 120, 122, respectively. Intermediate section 50 is preferably an extruded metal member formed of a material such as aluminum.

When leg intermediate section 50 is mounted between shoulder section 46 and foot 48, divider 116 is in alignment with separating wall 96 formed within recess 94 of foot base section 84, and with separator wall 70 in shoulder section recess 68. In this manner, front passage 120 of intermediate section 50 is aligned with and extends between front recessed area 98 of foot 48 and front recessed area 74 of shoulder section 46, and rear passage 122 is aligned with and extends between rear recessed area 100 of foot 48 and rear recessed area 76 of shoulder section 46.

A cover 126 is pivotably mounted to intermediate section 50 by means of a pivot connection 128 interposed between a forward end of cover 126 and intermediate section 50 at rearward end 112 defined by inner wall 110. Cover 126 is pivotable at pivot connection 128 for movement about a vertical pivot axis between a closed position, as shown in solid lines in FIG. 6, and an open position as shown in phantom. Cover 126 defines a wall which extends between and fills the space defined by inner wall rearward end 112 and forward end 114 of rear wall 108 when cover 126 is in its closed position. A pair of engagement members 130 extend from the inner surface of cover 126, and each engagement member 130 defines a bead 132 at its outer end. Engagement members 130 are spaced apart a distance sufficient to enable bead 118 at the inner end of divider wall 116 to be received therebetween, and beads 132 of engagement members 130 engage bead 118 to releasably maintain cover 126 in its closed position. Cover 126 is movable to its open position by application of an outward pulling force on cover 126, which disengages beads 132 from bead 118 at the inner end of divider 116, to provide access to front and rear passages 120, 122, respectively. Cover 126 is placed in its closed position by application of an inward force on cover 126 to move cover 126 toward divider 116, and beads 132 pass over bead 118 at the inner end of divider 116 as cover 126 is pivoted toward its closed position, for releasably maintaining cover 126 in its closed position.

Referring to FIGS. 1–4, wire management structure 26 generally includes a front panel assembly 136 and an access member 138. In a manner to be explained, front panel assembly 136 is movable relative to table top 22 between an operative extended position and an inoperative folded position. Access member 138 is movable relative to front panel assembly 136 between an open position and a closed position when front panel assembly 136 is in its operative extended position, and is movable to a collapsed position when front panel assembly 136 is in its inoperative folded position.

Front panel assembly 136 includes a pair of end frame members 140, each of which defines an outer end mounted to a cross brace member 142. A wall 144 extends between end frame members 140. Wall 144 defines an inner end 146 spaced slightly below underside 30 of table top 22, and an outer end 148 spaced above cross brace member 142. A support wall 150 extends rearwardly from panel wall 144 at its outer end 148, and a mounting flange 152 extends from the rearward end of support wall 150.

Figure 11:
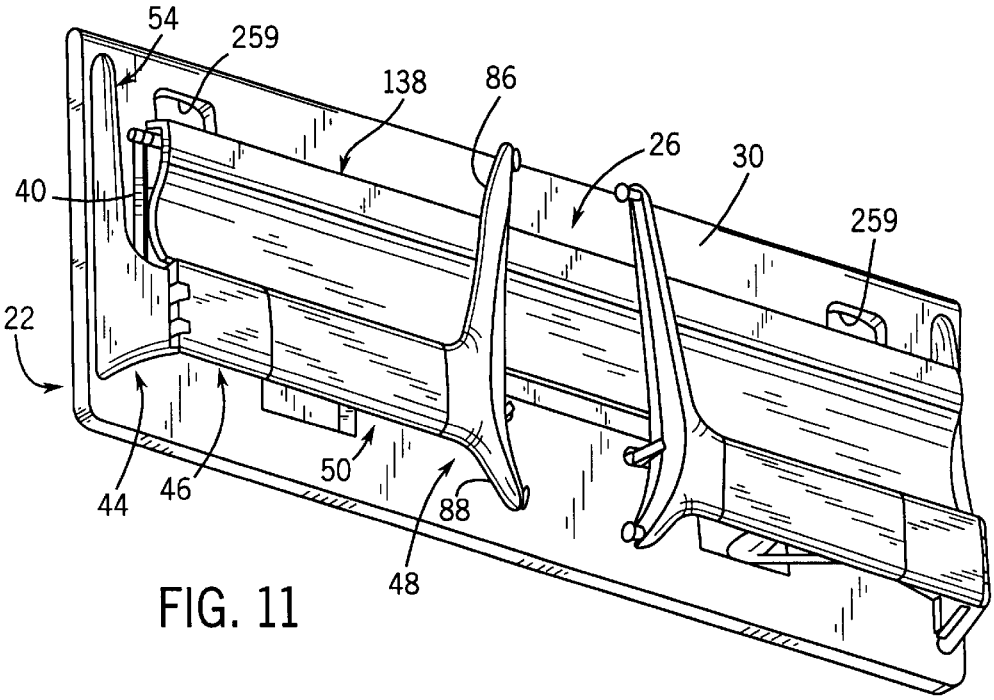
FIG. 11 is an isometric view illustrating both the wire management structure and the legs in their inoperative folded positions.

A pair of hinge assemblies 154 are interposed between table top 22 and front panel assembly 136. Each hinge assembly 154 includes a stationary leaf 156 mounted to underside 30 of table top 22, and a movable leaf 158 mounted to panel wall 144. A hinge pin 160 provides pivoting movement of leaf 158 relative to leaf 156, to thereby provide pivoting movement of front panel assembly 136 relative to table top 22. Front panel assembly 136 is pivotable about hinge pins 160 between an extended position, as shown in FIG. 3, and a folded position against underside 30 of table top 22, as shown in FIG. 11.

Outer end 148 of panel wall 144 is spaced from cross brace member 142, so as to define an access opening 162 therebetween. A resilient closure member 164 is placed within opening 162. Closure member 164 includes a mounting flange 166 secured to support wall 150 for mounting closure member 164 to panel wall 144, and a closure flap 168 extending downwardly from the front end of mounting flange 166. Closure flap 168 has a length greater than the height of opening 162, such that its lower end overlaps cross brace member 142 and is positioned inwardly thereof. Closure flap 168 functions to fill access opening 162 throughout the width of front panel assembly 136.

A mounting bracket 170 is secured to the inside surface of panel wall 144. An electrical receptacle assembly 172 is engaged with mounting bracket 170, and includes a series of power receptacles 174 along its length. Representatively, receptacle assembly 172 may be that such as is available from Group Dekko of Kendallville, Ind. under its Part No. 225453, or any other satisfactory electrification assembly known to those skilled in the art.

Mounting flange 152 at the outer end of support wall 150 is provided with a series of spaced openings 176. Each opening 176 is adapted to receive a conventional communication jack assembly 178 (FIG. 3).

Access member 138 includes a rear panel 180 defining an upper edge 182 and terminating in a lower end 184. A bottom panel 186 extends forwardly from lower end 184 of rear panel 180. Bottom panel 186 is formed integrally with a clamping structure which includes a front clamping member 188 and a rear clamping member 190. Front clamping member 188 extends tangentially in a forward direction from the lower surface of bottom panel 186, defining an arcuate shape terminating in an end 192. Rear clamping member 190 extends upwardly and forwardly from the upper surface of bottom panel 186, and cooperates with front clamping member 188 to form an arcuate shape defining a nearly circular cross-section. Rear clamping member 190 terminates in an end 194 spaced from end 192 of front clamping member 188. In a preferred form, access member 138 is an extruded member formed of a relatively lightweight material such as plastic or any other satisfactory material. The material of access member 138 making up front and rear clamping members 188, 190, respectively, is relatively rigid.

Cross brace member 142 is in the form of a tubular member defining an outward protrusion 196 along its length. Front and rear clamping members 188, 190 define an open internal passage within which cross brace member 142 is received, for providing pivotable mounting of access member 138 to cross brace member 142 about a pivot axis defined by the longitudinal axis of cross brace member 142. When access member 138 is in its closed position of FIG. 3, protrusion 196 of cross brace member 142 is located between end 192 of front clamping member 188 and end 194 of rear clamping member 190. Engagement of clamping member ends 192, 194 with protrusion 196 functions to releasably maintain access member 138 in its closed position. In this position, access member 138 cooperates with panel assembly 136 to define an internal cavity located below table top 22 and openings 38, and extending throughout the width of wire management structure 26 between leg assemblies 24.

Figure 13A:
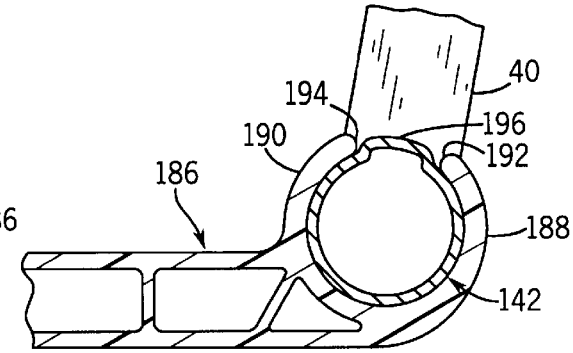
FIG. 13A is a partial section view of a lower portion of the wire management structure of the table assembly of FIG. 1, illustrating mounting of the access member to the cross brace member and the pivot connection between the access member and the cross brace member when the access member is in its closed position.
Figure 13B:
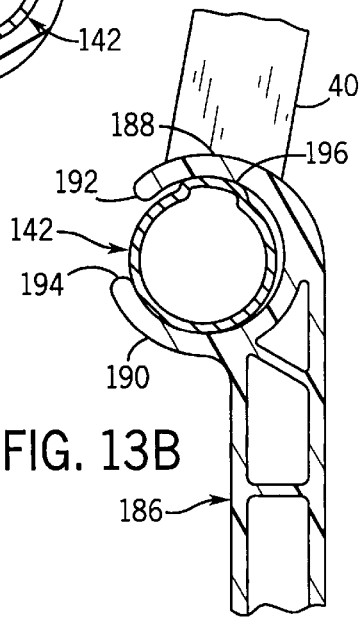
FIG. 13B is a view similar to FIG. 13A, showing positioning of the components when the access member is in its open position.

Access member 138 is movable relative to front panel assembly 136 between a closed position as shown in FIGS. 1, 3 and 13A, and an open position as shown in FIGS. 2 and 13B. To move access member 138 from its closed position to its open position, a user engages upper edge 182 of access member rear panel 180 below underside 30 of table top 22, and exerts a rearward and downward force on access member 138. Clamping members 188, 190 maintain engagement with cross brace member 142, and application of such a force to access member 138 results in end 192 of front clamping member 188 riding over protrusion 196, which functions to separate front clamping member 188 and rear clamping member 190, as shown in FIG. 13B. When it is desired to return access member 138 to its closed position, the user exerts an upward and forward force on access member 138 so as to return access member 138 to its closed position of FIGS. 1, 3 and 13A, in which protrusion 196 is again located between ends 192, 194 of front and rear clamping members 188, 190, respectively. Clamping members 188, 190 return to their original condition due to the resiliency of the material from which clamping members 188, 190 are formed, so as to again engage ends 192, 194 with protrusion 196 to maintain access member 138 in its closed position. Access member 138 can be repeatedly opened and closed in this manner, and clamping members 188, 190 remain operable to releasably maintain access member 138 in its closed position.

Figure 10:
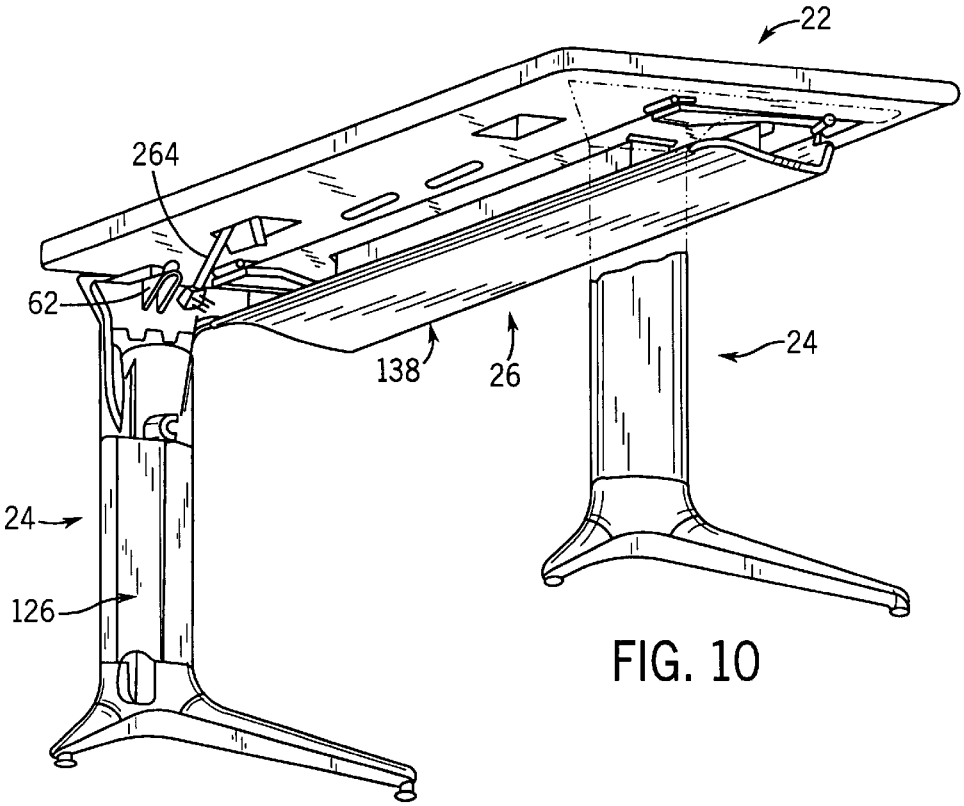
FIG. 10 is an isometric view of the underside of the table of FIG. 1, showing movement of the wire management structure to an inoperative folded position and the legs in an operative extended position.

Access member 138 can also be moved to a collapsed position, as shown in FIG. 10, when front panel assembly 136 is pivoted to its inoperative folded position against underside 30 of table top 22 by operation of hinge assemblies 154. Movement of access member 138 to its collapsed position of FIG. 10 is accomplished by exerting an upward force on access member 138 to fold access member 138 toward front panel assembly 136. When access member 138 is moved to its collapsed position, end 194 of rear clamping member 190 rides over protrusion 196 for moving clamping members 188, 190 apart from each other, in a manner similar to that described above with respect to movement of access member 138 toward its open position. When desired, access member 138 can subsequently be placed in its open position by exerting a force on access member 138 away from front panel assembly 136, to again result in placement of protrusion 196 between ends 192, 194 of front and rear clamping members 188, 190, respectively.

Figure 7:
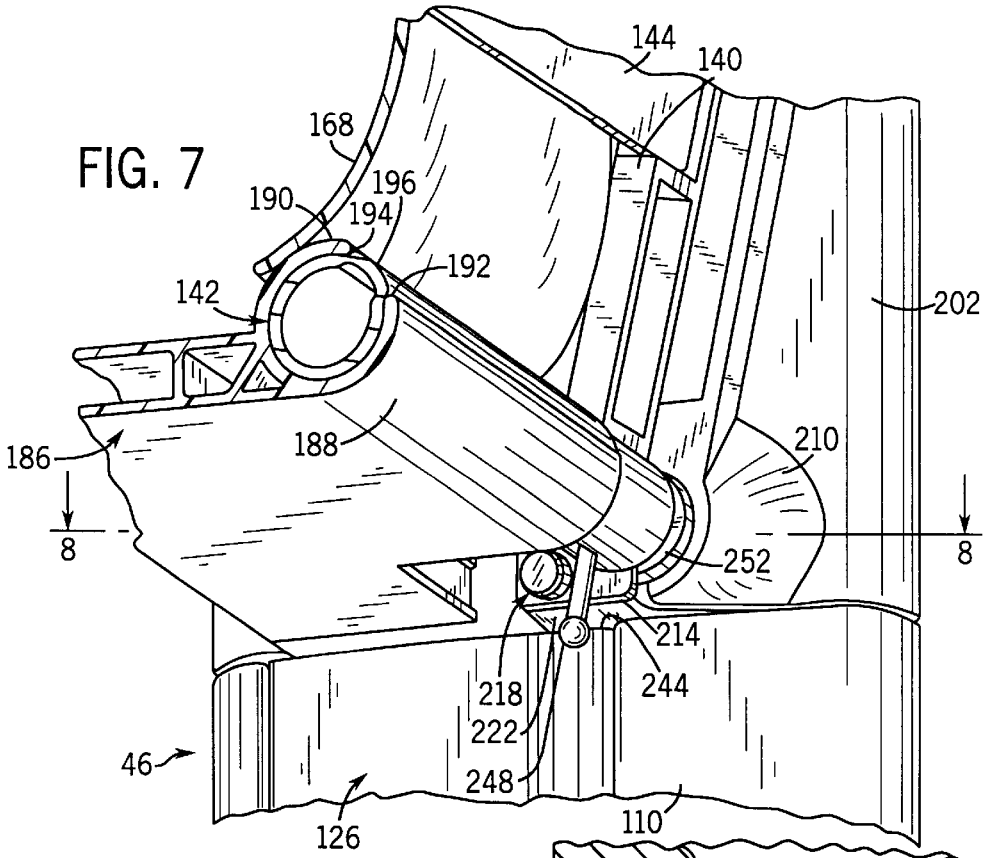
FIG. 7 is a partial isometric view illustrating a lower portion of the wire management structure of FIG. 3 and its interconnection with a leg of the table assembly.
Figure 8:
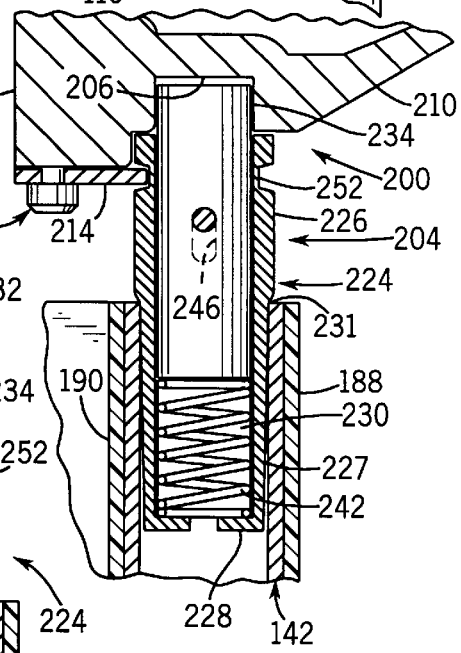
FIG. 8 is a partial section view taken along line 8—8 of FIG. 7, showing engagement of a cross brace member forming a part of the wire management structure within a receiver associated with the leg.
Figure 9:
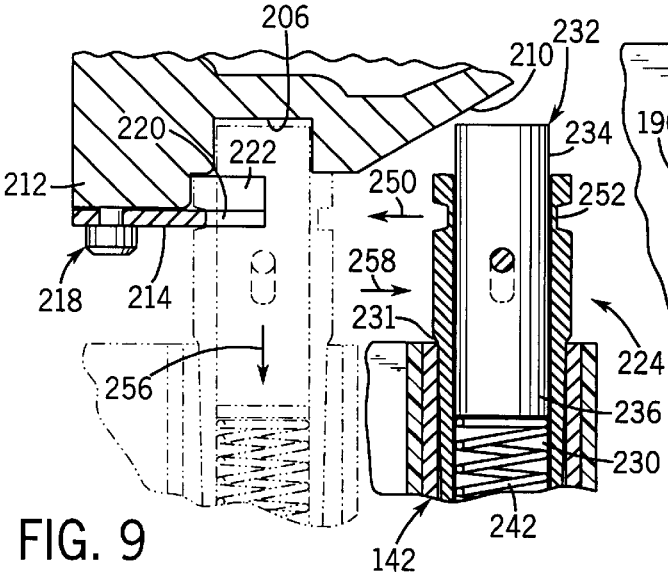
FIG. 9 is a view similar to FIG. 8, showing disengagement of the cross brace member of the wire management structure from the leg.

When wire management structure 26 is in its operative extended position and each leg 24 is in its operative extended position, as shown in FIGS. 1–5, cross brace member 142 is engaged with leg assemblies 24 to impart rigidity to the supporting structure of table assembly 20 and to prevent legs 24 from moving to their folded position. FIGS. 7–9 illustrate a releasable engagement arrangement interposed between each end of cross brace member 142 and each leg assembly 24, which enables cross brace member 142 to be selectively engaged with and disengaged from one of leg assemblies 24, for imparting rigidity to table assembly 20 in operation and for enabling the components of table assembly 20 to be folded for transport or storage.

Referring to FIGS. 7–9, the releasable engagement arrangement includes receiving structure 200 provided on the inner wall, shown at 202, of leg shoulder section 46, in combination with an extendible and retractable engagement assembly 204 mounted to each end of cross brace member 142. Receiving structure 200 includes a recess 206. A ramp 210 is formed on inner wall 202 forwardly of recess 206, and a mounting boss 212 is located rearwardly of recess 206. Mounting boss 212 defines a threaded passage, and a retainer plate 214 is engaged with the end of mounting boss 212. A screw 218 extends into the threaded passage in boss 212, for mounting retainer plate 214. An arcuate notch 220 is formed in the forward edge of retainer plate 214. A lower wall 222 engages the bottom edge of retainer plate 214 below notch 220.

Extendible and retractable engagement assembly 204 includes a cylindrical member 224 mounted within the open end of cross brace member 142. Cylindrical member 224 defines an outer side wall 226 and an inner side wall 227 terminating in an open end wall 228, which cooperate to define an outwardly opening internal cavity 230. A shoulder 231 is located between outer side wall 226 and inner side wall 227. Cylindrical member 224 is mounted to cross brace member 142 by inserting inner side wall 227 into the open end of cross brace member 142 until shoulder 231 engages the end of cross brace member 142, as shown in FIG. 9. Longitudinal slots are formed in inner side wall 227 so as to enable inner side wall 227 to deflect inwardly during insertion into cross brace member 142, such that cylindrical member 224 is mounted to cross brace member 142 with a friction fit engagement.

A plunger member 232 is engaged within internal cavity 230, and includes a head portion 234 and an inner portion 236 received within the passage of cylindrical member 224. Head portion 234 is configured to be received within recess 206. A spring 242 is received within cylindrical member internal passage 230. The inner end of spring 242 engages end wall 228 of cylindrical member 224, and the outer end of spring 242 bears against the inner end of plunger member 232.

Plunger member 232 includes a finger pull member 244 defining an inner portion engaged within a passage formed in plunger inner portion 236, and an outer portion extending outwardly therefrom through a slot 246 formed in side wall 226 of cylindrical member 224. An engagement knob 248 is located at the outer end of finger pull member 244 for facilitating engagement therewith by a user. Spring 242 functions to bias plunger member 232 outwardly toward a position in which finger pull member 244 engages the outer end of slot 246.

FIG. 9 illustrates cross brace member 142 positioned forwardly of receiving structure 200. In order to engage cross brace member 142 between leg assemblies 24, the user moves front panel assembly 136 toward its operative extended position of FIG. 3, in the direction of arrow 250. As front panel assembly 136 approaches its operative extended position, plunger head portion 234 engages ramp 210, which functions to move plunger member 232 inwardly into internal cavity 230 of cylindrical member 224. This results in inward movement of finger pull member 244 within slot 246 against the force of spring 242. When front panel assembly 136 is in its operative extended position, head portion 234 of plunger member 232 is positioned over recess 206 and spring 242 urges plunger member 232 outwardly to engage head portion 234 within recess 206, as shown in FIG. 8. Notch 220 in retainer plate 214 engages plunger member 232 at a groove 252 defined in the outer surface of head portion 234, to ensure that cross brace member 142 cannot be moved beyond a position in which head portion 234 of plunger member 232 is positioned in alignment with recess 206.

The structure of head portion 234 and recess 206, in combination with engagement of retainer plate 214 within groove 252 functions to impart stability to table assembly 20 upon application of lateral transverse forces to table assembly 20 through table top 22. Further, such engagement of cross brace member 142 maintains leg assemblies 24 in their operative extended positions.

To enable wire management structure 26 to be moved to its inoperative folded position of FIG. 10, the user grasps the outer end of finger pull member 244 using knob 248, and exerts an inward force in the direction of arrow 258 (FIG. 9) for withdrawing head portion 234 of plunger member 232 out of recess 206, as shown in phantom in FIG. 9. This results in movement of finger pull member 244 within slot 246 against the force of spring 242. Once head portion 234 has cleared recess 206, the user exerts an upward and forward force on wire management structure 26, and moves front panel assembly 136 to its inoperative folded position of FIG. 10.

It can thus be appreciated that extendible and retractable engagement assembly 204 provides automatic engagement of cross brace member 142 with leg assemblies 24 when wire management structure 26 is moved to its operative extended position, and provides a rigid releasable engagement structure for bracing leg assemblies 24 against lateral movement.

In operation, once wire management structure 26 is in its inoperative folded position of FIG. 10 and access member 138 is in its collapsed position, the user folds leg assemblies 24 toward each other over wire management structure 26 as shown in FIG. 11 to prepare table assembly 20 for storage or transport. When wire management structure 26 is in its inoperative folded position and access member 138 is in its collapsed position, the space occupied by wire management structure 28 is significantly less than that occupied by wire management structure 26 when in its extended operative position of FIG. 3. When folded in this manner, wire management structure 26 occupies a space less than that defined between underside 30 of table top 22 and the hinge axis of leg assemblies 24, defined by the hinge pin received within hinge knuckles 64, 80. The user is then able to lift and transport table assembly 10 using hand grip recesses 259 formed in underside 30 of table top 22.

Referring to FIG. 12, rear edge 34 of table top 22 and the rearward end of foot rearward extension 88 are substantially coplanar. With this construction, table assembly 20 can be supported on supporting surface 92 by table top rear edge 34 and the end of foot rearward extension 88, which significantly facilitates storage and handling of table assembly 20 when folded.

Referring to FIGS. 1–3, a power supply cable 260 and a communication cable 262 are routed through one of leg assemblies 24 and into the internal cavity of wire management structure 26 by first moving access member 138 of wire management structure 26 to its open position and moving leg cover 126 to its open position. Wire management structure 26 and cover 126 are configured and arranged such that access member 138 and cover 126 can both be in the open position at the same time, to provide lay-in capability for power supply cable 260 and communication cable 262. Power supply cable 260 is positioned within front passage 120 of leg intermediate section 50, and communication cable 262 is placed within rear passage 122 of leg intermediate section 50. Divider 116 maintains power cables 260 and communication cables 262 apart from each other, to prevent RF interference and to ensure proper operation. Recess 68 in leg shoulder section 46 is in communication with the internal cavity wire management structure 26, such that cables 260, 262 extend directly from leg assembly 24 into the internal cavity of wire management structure 26. Once cables 260, 262 are engaged within leg passages 120, 122, respectively, as described, cover 126 is moved to its closed position as shown in solid lines in FIG. 6 to maintain cables 260, 262 in position and to provide an aesthetically pleasing external appearance of leg assembly 24. Power supply cable 260 is engaged with receptacle assembly 172 for providing electrical power thereto in a manner as is known, and communication cable 262 is interconnected with a communication jack 178 in a manner as is known. A number of power supply cables 260 and communication cables 262 can be routed through leg assembly 24 in this manner, for providing a desired number of electrical power circuits and communication receptacles for each table assembly 20.

Cables or wires extending from equipment supported by upper surface 28 of table top 22 is routed through grommet assemblies 40 and into the internal cavity defined by wire management structure 26, for engagement with power receptacles 174 and communication jacks 178. The internal cavity of wire management structure 26 provides sufficient space for receiving any excess amount of such wires or cables in order to prevent cluttering of the top of table top 22. Referring to FIG. 3, a power cord extending from equipment supported by table top 22 is shown at 264, including a plug 266 for engagement with one of receptacles 174.

Figure 4:
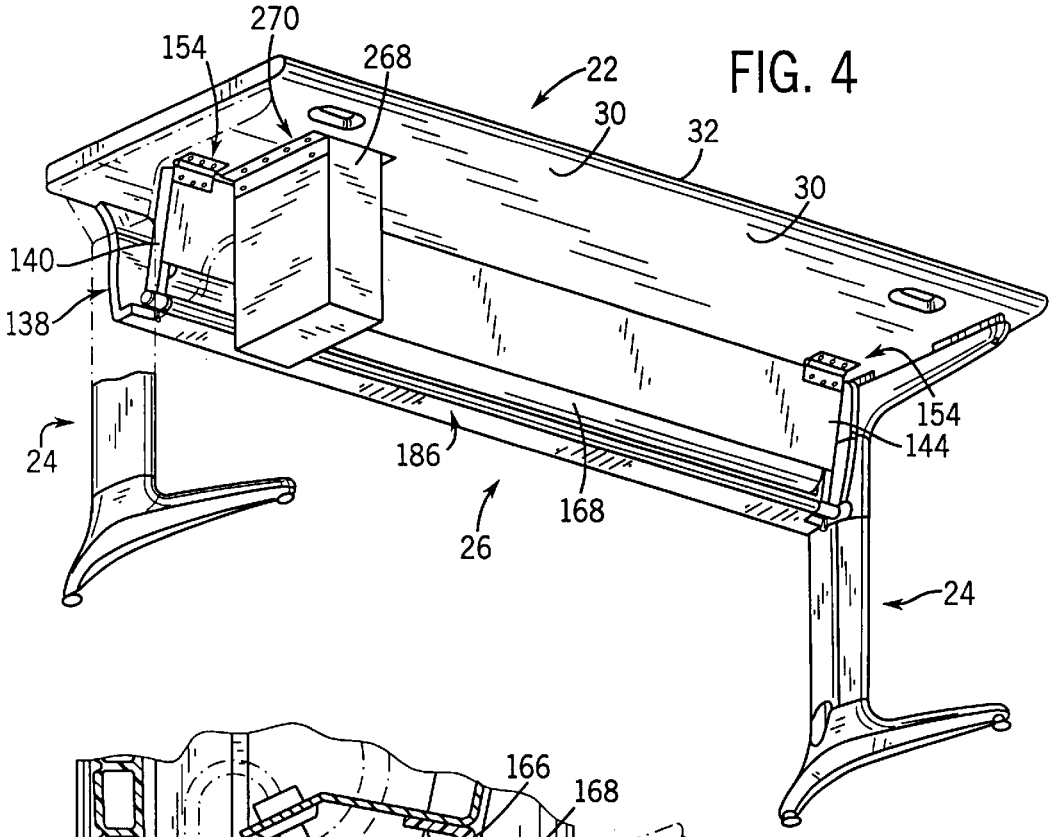
FIG. 4 is an isometric view showing the underside of the table assembly of FIG. 1.
Figure 5:
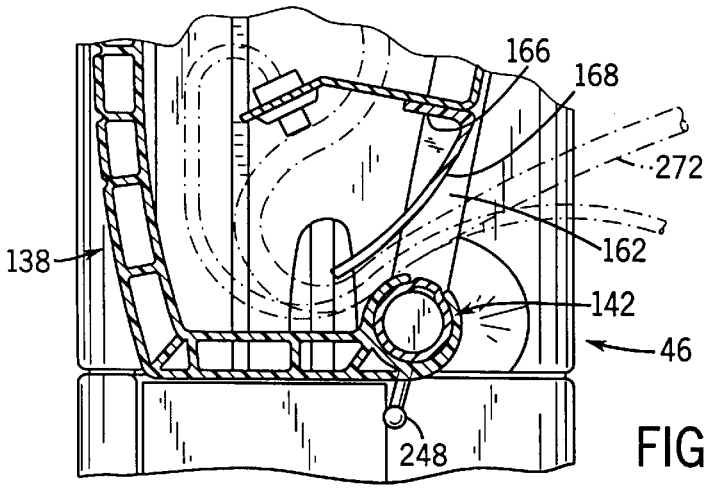
FIG. 5 is a partial section view of a lower portion of the wire management structure illustrated in FIG. 3.

Referring to FIGS. 4 and 5, equipment such as a CPU 268 can be supported by underside 30 of table top 22 by means of a bracket arrangement 270, in order to eliminate the need for supporting such equipment on upper surface 28 of table top 22. Wires or cables, such as 272, which extend from CPU 268 can be passed through opening 162 into the internal cavity of wire management structure 26 for engagement with a power receptacle 174 or communication jack 178, such that wires or cables such as 272 can be fed into wire management structure 26 without use of access member 138. The user passes wires or cables 272 through opening 162 by deflecting the lower end of closure flap 168 way from cross brace member 142 to create a passage into the internal cavity of wire management structure 26, and closure flap 168 forms around such wires or cables 272 to close opening 102.

Figure 14:
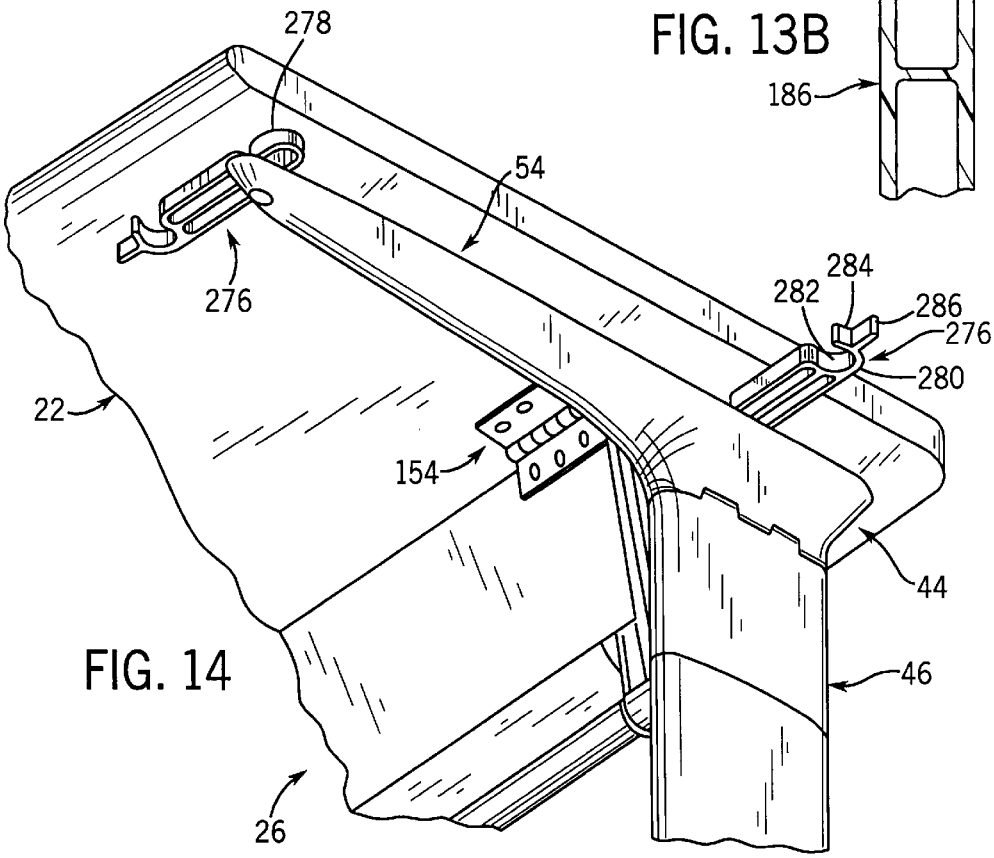
FIG. 14 is a partial isometric view of an end portion of the table assembly of FIG. 1, illustrating a pair of table ganging latch members for releasably securing a pair of adjacent table assemblies together.

Referring to FIGS. 14–16, a pair of latch members 276 are mounted to one end of table assembly 20 within space 58 for selectively ganging table assembly 20 with another table assembly, such at 20*a*. Each latch member 278 defines an inner end 280 which includes a vertical passage within which one of mounting bosses 60 is received, for providing pivoting movement of latch member 276 between a storage position and a latching position. Each latch member 276 further includes an outer engagement end 280 spaced from inner end 278. Engagement end 280 defines an open engagement recess 282 which is in part defined by an engagement finger 284 having a tab 286 extending therefrom.

When table assembly 20 is to be used alone, latch members 276 are positioned in the storage position as shown in solid lines in FIG. 15, in which each latch member 276 is positioned in line with the upper edge of mounting section 44, within space 58 defined between upper surface 56 and underside 30 of table top 22. When it is desired to gang table assembly 20 with table assembly 20*a*, the user grasps tab 286 of each latch member 276 and pivots latch member 276 outwardly to the phantom line position as shown in FIG. 15.

Table assembly 20*a* is then moved into position adjacent table assembly 20 as shown in FIG. 16, and the user pivots latch member 276 to the operative latching position in which each mounting boss 60 of table assembly 20*a* is received within engagement recess 282 of one of latch members 276. Engagement finger 284 flexes outwardly to enable mounting boss 60 to pass into engagement recess 282, and engagement finger 284 resiliently clamps mounting boss 260 within engagement recess 282 so as to releasably secure engagement end 280 of latch member 276 with one of mounting bosses 60 of table assembly 20*a*. To disengage latch member 276, the user exerts an axial force on latch member 276 in the opposite direction, to disengage engagement end 280 from mounting boss 60, and latch member 276 is returned to its storage position.

With this arrangement, table ganging capability is provided for each table assembly 20 without the need for separate table ganging components. The latch members 276 are assembled with the remaining components of each table assembly at one end of the table assembly, and are always available when desired for ganging table assemblies together. Latch members 276 are provided at one end of table assembly 20 only, such that mounting bosses 60 are exposed at the opposite end for engagement by latching members 276 of an adjacent table assembly.

When table assemblies such as 20, 20*a* are ganged together in this manner, a power supply jumper 288 can be employed to provide electrification to an adjacent table assembly by passing jumper 288 within space 58 into engagement with power receptacle assembly 172 of the adjacent table assembly 20. Similarly, communication cables can also be passed through space 58 for providing communication to jacks 178 of the adjacent table assembly 20.

Figure 17:
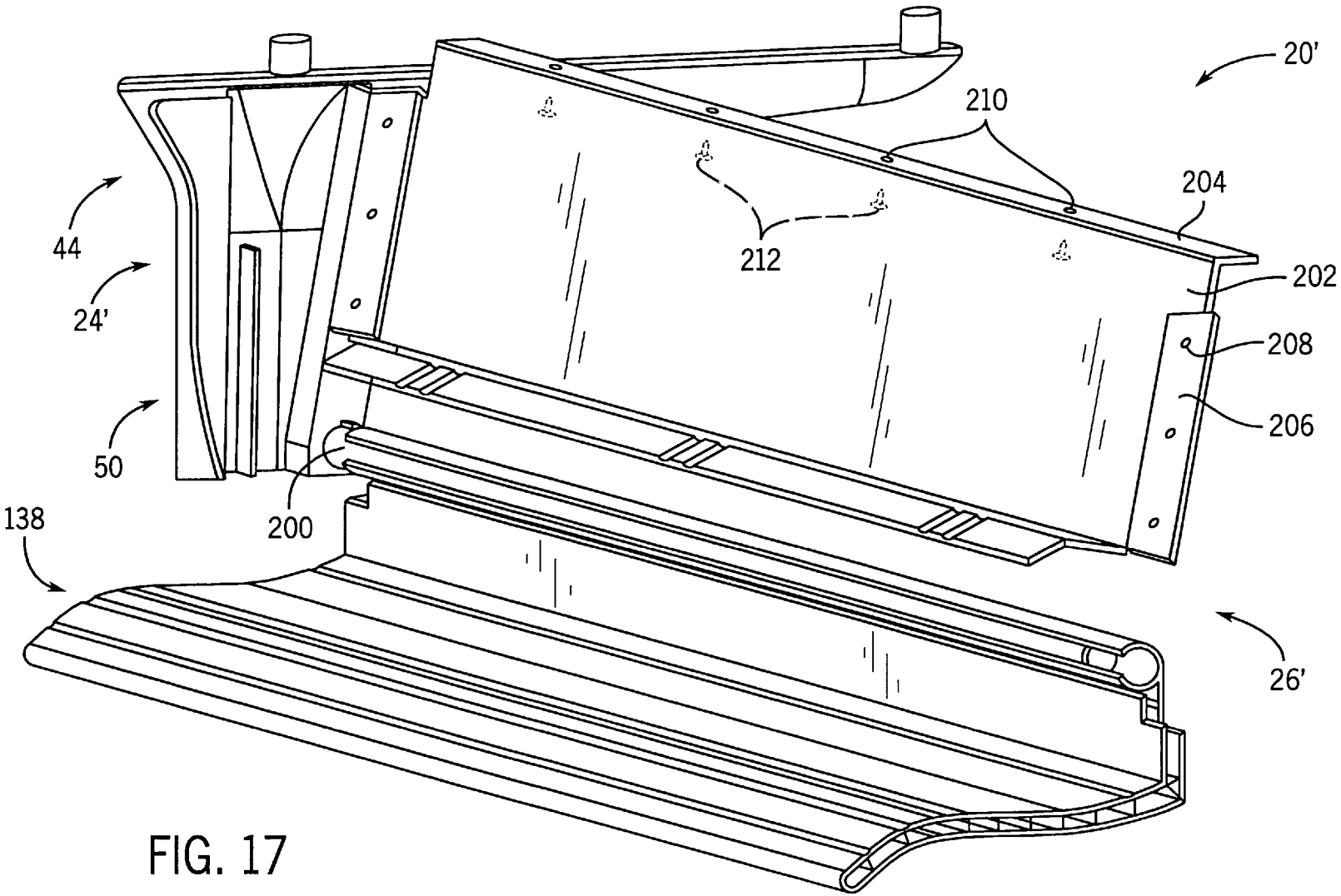
FIG. 17 is a partial isometric view illustrating components of a fixed-leg embodiment of a table assembly similar to that illustrated in FIGS. 1–16.

FIG. 17 illustrates a fixed-leg table assembly 20' constructed according to the invention, and like reference characters will be used where possible to facilitate clarity. In this embodiment, folding leg assemblies 24 are replaced with fixed leg assemblies 24', which have the same general construction as leg assemblies 24 with the exception that the hinge knuckles such as 64, 80 are omitted and leg intermediate section 50 extends the full length from the upper end of foot 48 to the lower end of upper mounting section 44. Cross brace member 142 is replaced with a cross brace member 200 which has a length sufficient to extend the entire distance between leg assemblies 24'. The ends of cross brace member 200 may extend into recesses in the inner facing surfaces of leg assemblies 24'. Cross brace member 200 includes a protrusion 196 like cross brace member 142, and access member 138 is mounted to cross brace member 200 in the same manner as described above with respect to cross brace member 142.

Wire management structure 26' of table assembly 20' includes a front wall 202 having a lip 204 formed at its upper end. A pair of angle members 206 are mounted to the ends of front wall 202. Angle member 206 is adapted for engagement with one of leg assemblies 24' by means of threaded fasteners which extend through openings 208 formed in angle members 206 and into threaded passages in leg assembly 24' in alignment with openings 208, to maintain the ends of cross brace member 200 within the recesses in leg assemblies 24' and to thereby form a rigid frame assembly. Lip 204 is oriented so as to be in close proximity to underside 30 of table top 22 when front wall 202 is mounted between leg assemblies 24' in this manner. Openings 210 are formed in lip 204, and screws 212 extend through openings 204 and into table top 22 to secure front wall 202 to table top 22. Other than the stationary mounting of front wall 202, wire management structure 26' operates similarly to wire management structure 26 to receive wires and cables and to provide power and communication connections.

Figure 18:
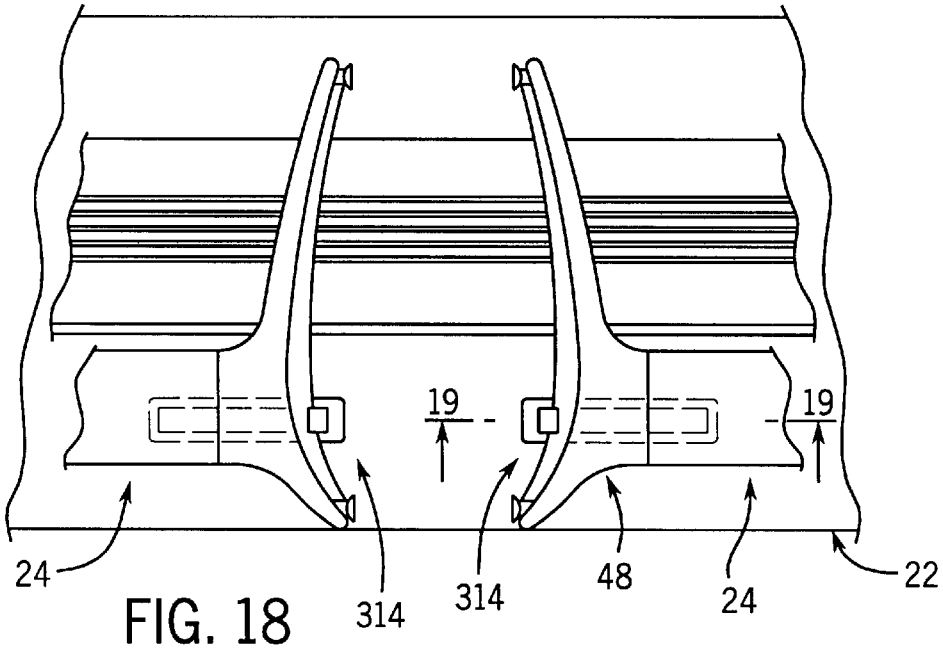
FIG. 18 is a partial bottom plan view showing the leg assemblies in their folded position and latch mechanisms associated with the table top and engaged with the leg assemblies.

FIG. 18 illustrates leg assemblies 24 in the folded position of FIGS. 11 and 12, and a pair of leg latch mechanisms 314 for preventing movement of leg assemblies 24 away from their folded positions.

Figure 19:
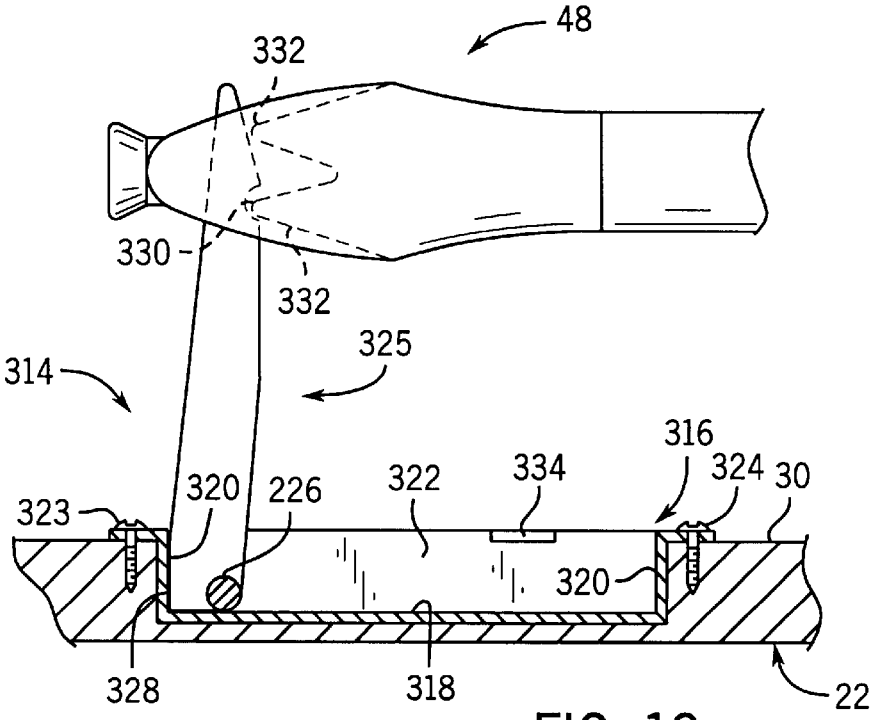
FIG. 19 is a partial section view taken along line 19—19 of FIG. 18.

Referring to FIG. 19, each leg latch mechanism 314 includes a housing 316 which is received within a recess formed in table top 22 and extending upwardly from underside 30. Housing 316 includes an upper wall 318, a pair of end walls 320 and a pair of side walls 322. A flange 323 is located at the upper ends of walls 320, 322, and is adapted for engagement with underside 30 of table top 22. Screws 324 extend through openings in flange 323 for mounting housing 316 to table top 22.

A latch member 325 is mounted to housing 316 for pivoting movement between a latching position as shown in FIG. 19 and a retracted, storage position. Latch member 325 includes a pair of pegs 326 extending outwardly from either side of latch member 325. Notches are formed in housing side walls 322, and each notch is adapted to receive one of pegs 326 for providing pivotable mounting of latch member 324 relative to housing 316. Latch member 325 further defines an engagement surface 328 toward its inner end, and an engagement notch 330 located toward its outer end.

Figure 20:
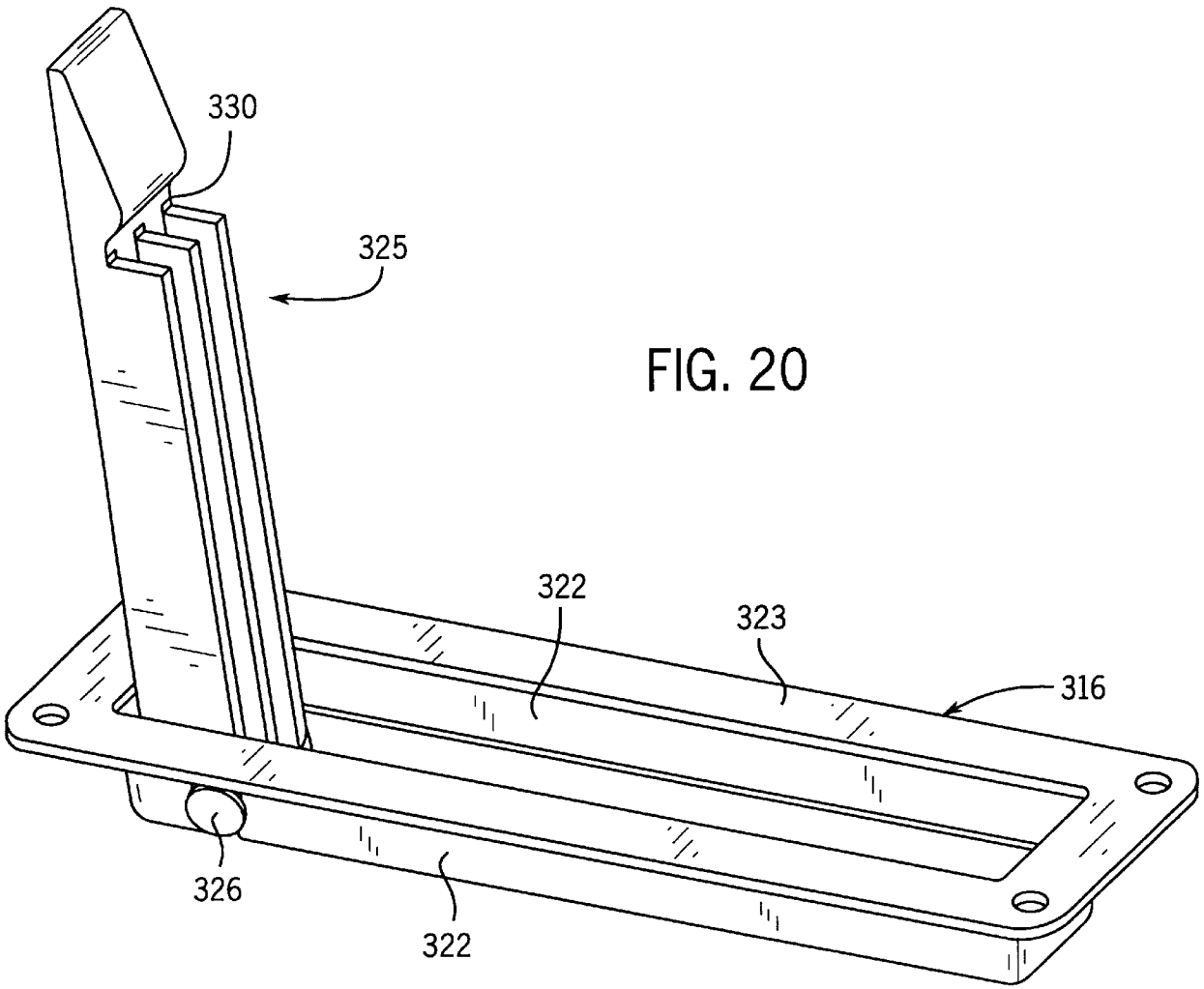
FIG. 20 is an isometric view of the latch mechanism of FIG. 19, showing the latch member in its operative extended position.

As shown in FIGS. 19 and 20, movement of latch member 325 to its extended, operative position results in abutment of engagement surface 328 with housing end wall 320, to place latch member 325 in an outwardly extending position in preparation for engagement with foot 48 of one of leg assemblies 24. As shown in FIG. 19, foot 48 includes a pair of ridges 332 on its underside, and latch member 325 is positioned such that the end of the lower one of ridges 332 is received within notch 330. Latch member 325 is oriented relative to foot 48 such that engagement of the end of ridge 332 within notch 330 results in latch member 325 deflecting outwardly, i.e. in a counterclockwise direction with reference to FIG. 19. Latch member 325 is preferably constructed of a resilient plastic material, which results in application of a biasing force in a counterclockwise direction so as to urge engagement of the end of ridge 332 within notch 330. With this arrangement, latch members 325 function to maintain each leg assembly 24 in its folded condition during transport, handling and storage.

Figure 21:
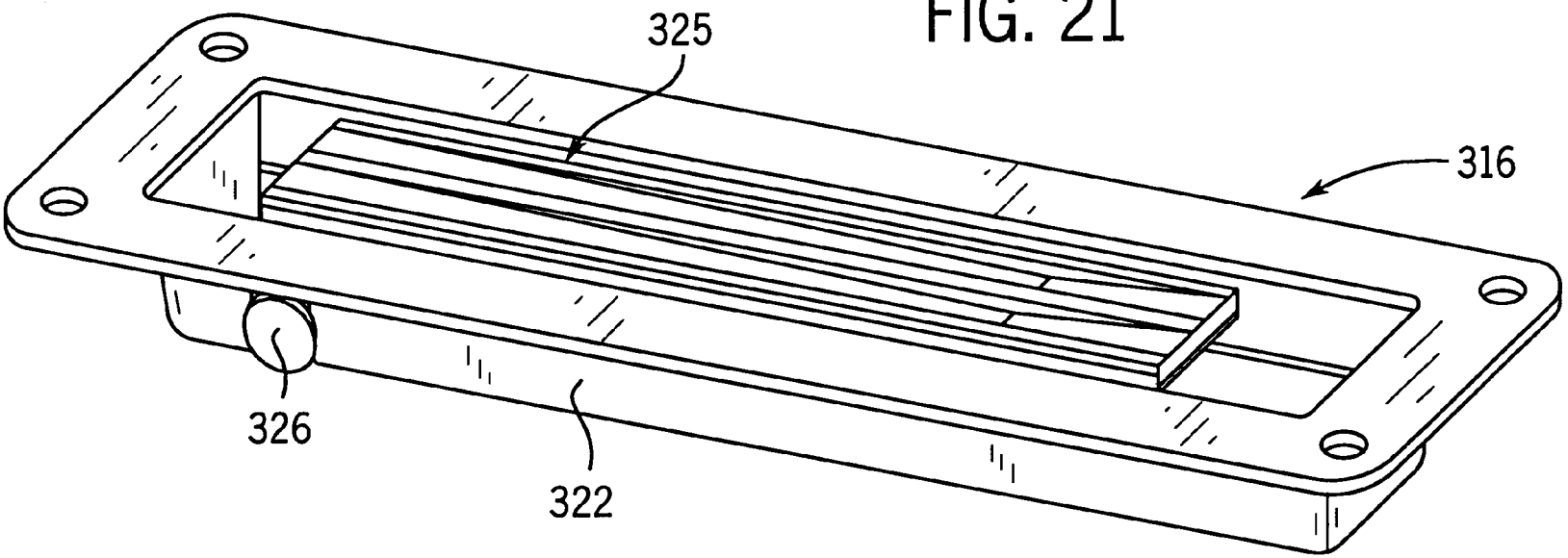
FIG. 21 is a view similar to FIG. 20, showing the latch member in its retracted, storage position.

When it is desired to move leg assembly 24 to its extended, unfolded position, the user applies a lateral force on the end of latch member 325, such as by application of thumb or finger pressure, to move latch member 325 out of engagement with foot 48 by releasing engagement of the end of ridge 332 within notch 330. Once latch member 325 is moved so as to clear notch 330, the user lifts leg assembly 24 upwardly to its operative unfolded position as described above. Latch member 325 is then pivoted downwardly to its storage position within housing 316, as shown in FIG. 21, so as to remain out of the way during use of table assembly 20. A resilient retainer member 334 is mounted to one of sidewalls 322, to releasably maintain latch member 325 in its retracted, storage position.

Table assembly 20 incorporates a number of features which accommodate quick and simple movement of the components from an operative extended position to an inoperative folded position. The components provide a relatively compact folded envelope, and provide a rigid table assembly when unfolded which incorporates a number of advantageous features for accommodating wire and cable placement and supply of power and communication capabilities to the table assembly.

Various alternatives and embodiments are contemplated as being within the scope of the following claims particularly pointing out and distinctly claiming the subject matter regarded as the invention.

We claim:

1. A table assembly, comprising:

a table top;

a wire management housing mounted below the table top by means of a pivot connection providing movement of the wire management housing between an inoperative folded position in which the wire management housing is folded against the underside of the table top, and an operative unfolded position in which the wire management housing is unfolded away from the underside of the table top, wherein the wire management housing defines an internal cavity and includes a transversely extending brace member and an access member movably mounted to the brace member for movement between an open position for providing access to the internal cavity for placing wires within the internal cavity, and a closed position for preventing access to the internal cavity for maintaining wires within the internal cavity, wherein the access member is further movable to a collapsed position when the wire management housing is in its inoperative folded position to reduce the volume of the internal cavity relative to the volume of the internal cavity when the access member is in its closed position, and wherein the wire management housing further includes an opening in communication with the internal cavity, separate from the access member, for providing access to the internal cavity from below the table top other than through the access member;

a pair of legs mounted to the underside of the table top, wherein the wire management housing is located between the pair of legs, and wherein each leg includes an upper mounting portion rigidly secured to the underside of the table top, and a lower portion movably mounted to the upper mounting portion by means of a pivot connection spaced outwardly from the underside of the table top such that, when the wire management housing is in its inoperative folded position and the access member is in its collapsed position, the leg lower portions are pivotable toward each other over the wire management housing to a folded position in which the leg lower portions are substantially in line with each other and are oriented substantially parallel to the underside of the table top, wherein each leg includes a wire management recess extending throughout at least a portion of its length, and a cover movably mounted to the leg adjacent the recess for movement between an open position providing access to the recess for placing wires into the recess, and a closed position preventing access to the recess for retaining wires within the recess;

wherein the wire management arrangement of the leg and the wire management housing are configured and arranged relative to each other to enable the cover of the wire management arrangement and the access member of the wire management housing to both be in the open position at the same time, to provide lay-in placement of wires into the wire-receiving recess of the leg and into the internal cavity of the wire management housing; and a releasable engagement arrangement interposed between the legs and the brace member for engaging the brace member with the legs when the legs are in their operative extended positions and the wire management housing is in its operative unfolded position, for bracing the legs against movement away from their operative extended positions, wherein the releasable engagement arrangement provides disengagement of the brace member from the legs to enable the legs and the wire management housing to be moved to their inoperative folded positions.

2. A table assembly, comprising:

a table top;

a wire management housing mounted below the table top by means of a pivot connection providing movement of the wire management housing between an inoperative folded position in which the wire management housing is folded against the underside of the table top, and an operative extended position in which the wire management housing is unfolded away from the underside of the table top, wherein the wire management housing includes a pair of end frame members, each of which defines an upper end located adjacent the underside of the table top and a lower end spaced below the underside of the table top when the wire management housing is in its operative extended position, and a structural cross member interconnected between the pair of end frame members toward the lower ends of the end frame members;

a pair of legs mounted to the underside of the table top, wherein the wire management housing is located between the pair of legs, and wherein each leg includes an upper mounting portion rigidly secured to the underside of the table top, and a lower portion movably mounted to the upper mounting portion by means of a pivot connection for movement between a folded position and an unfolded position, wherein the pivot connection is spaced outwardly from the underside of the table top such that, when the wire management housing is in its inoperative folded position, the leg lower portions are pivotable toward each other over the wire management housing to a folded position; and a releasable engagement arrangement interposed between the structural cross member and the lower portions of the legs for releasably engaging the wire management housing to and between the pair of legs when the wire management housing is in its operative extended position and the legs are in the unfolded position, wherein the cross member extends between the lower portions of the legs at a location spaced below the underside of the table top when the legs are in the unfolded position and the cross member is releasably secured to the legs, to impart rigidity to the legs.

3. The table assembly of claim 2, wherein the wire management housing includes a panel member and an access member, wherein the panel member is connected to and located between the pair of end frame members.

4. A table assembly, comprising:

a table top;

a wire management housing mounted below an underside defined by the table top by means of a pivot connection providing movement of the wire management housing between an inoperative folded position in which the wire management housing is folded against the underside of the table top, and an operative extended position in which the wire management housing is unfolded away from the underside of the table top, wherein the wire management housing includes a panel member and an access member, wherein the pivot connection is interconnected with the panel member for providing movement of the wire management housing between its folded and unfolded positions, wherein the panel member and the access member are pivotably interconnected with each other for movement to a collapsed position when the wire management housing is in its inoperative folded position for reducing the space occupied by the wire management housing; and a pair of legs mounted to the underside of the table top, wherein the wire management housing is located between the pair of legs, and wherein each leg includes an upper mounting portion rigidly secured to the underside of the table top, and a lower portion movably mounted to the upper mounting portion by means of a pivot connection, wherein the pivot connection is spaced outwardly from the underside of the table top such that, when the wire management housing is in its inoperative folded position, the leg lower portions are pivotable toward each other over the wire management housing to a folded position.

5. The table assembly of claim 4, further comprising a cross brace member mounted to the panel member for releasable engagement with the pair of legs when the legs are in an extended position for preventing movement of the legs toward the folded position.

6. The table assembly of claim 5, wherein the access member is pivotably mounted to the cross brace member for movement between an open position and a closed position when the wire management housing is in its operative unfolded position, and is pivotable about the cross brace member for movement to its collapsed position when the wire management housing is in its inoperative folded position.

7. The table assembly of claim 6, wherein each leg includes a wire management arrangement including a wire-receiving recess and a cover movably mounted to the leg adjacent the recess for movement between an open position providing access to the recess for placing wires into the recess, and a closed position preventing access to the recess for retaining wires within the recess, and wherein the wire management arrangement and the wire management housing are arranged relative to each other such that the cover of the wire management arrangement and the access member of the wire management housing are capable of being in the open position at the same time, to provide lay-in placement of wires into the wire-receiving recess of the leg and into the wire management housing.

8. The table assembly of claim 5, wherein the cross brace member is releasably engageable with the pair of legs by means of a movable engagement member mounted to each of a pair of spaced ends defined by the cross brace member, and wherein each leg includes a receiver for receiving one of the engagement members when the leg is in its extended position.

9. The table assembly of claim 2, further comprising a latch arrangement mounted to the underside of the table top for releasably maintaining each leg in its folded position.

10. The table assembly of claim 9, wherein the latch arrangement comprises a pair of latch members, each of which is releasably engageable with the lower portion of one of the legs when in its folded position, wherein each latch member is mounted to a housing interconnected with the table top for movement between an extended latching position and a retracted storage position.

11. A table assembly, comprising:

a table top;

one or more legs interconnected with the table top for supporting the table top above a supporting surface;

a wire management arrangement associated with each leg and including a wire-receiving recess extending throughout at least a portion of the leg, and an outwardly movable cover mounted to the leg adjacent the recess, wherein the cover is movable between an open position in which the cover is moved outwardly relative to the leg and provides open access to the recess for placing wires into the recess, and a closed position in which the cover is moved inwardly from its open position into engagement with the leg for preventing access to the recess for retaining wires within the recess; and a wire management housing located below the table top and including an end portion located adjacent each leg, wherein the wire management housing includes an internal cavity which is in communication with at least a portion of the wire-receiving recess, and an access member movable between an open position for providing access to the internal cavity for placing wires within the internal cavity, and a closed position for preventing access to the internal cavity for maintaining wires within the internal cavity, wherein, when the access member is in its closed position, at least a portion of the access member extends across the wire-receiving recess and wherein, when the access member is in its open position, the access member is positioned out of alignment with the wire-receiving recess;

wherein the wire management arrangement of the leg and the wire management housing are configured and arranged relative to each other to enable the cover of the wire management arrangement and the access member of the wire management housing to both be in the open position at the same time, to provide lay-in placement of wires into the wire-receiving recess of the leg and the internal cavity of the wire management housing.

12. The table assembly of claim 11, wherein each leg further includes a divider wall which divides the wire-receiving recess into first and second sections, wherein each section is adapted to receive a separate set of wires.

13. The table assembly of claim 12, wherein the cover is releasably engageable with the divider wall for releasably maintaining the cover in its closed position.

14. A table assembly, comprising:

a table top;

one or more legs interconnected with the table top for supporting the table top above a supporting surface;

a wire management arrangement associated with each leg and including a wire-receiving recess extending throughout at least a portion of the leg, and a cover movably mounted to the leg adjacent the recess for movement between an open position providing access to the recess for placing wires into the recess, and a closed position preventing access to the recess for retaining wires within the recess;

a wire management housing located below the table top and including an end portion located adjacent each leg, wherein the wire management housing includes an internal cavity and an access member movable between an open position for providing access to the internal cavity for placing wires within the internal cavity, and a closed position for preventing access to the internal cavity for maintaining wires within the internal cavity, wherein the wire management housing further includes a panel member interconnected with the access member; and a pivot connection interconnected with the panel member for providing movement of the wire management housing between an inoperative folded position in which the wire management housing is folded against the underside of the table top, and an operative extended position in which the wire management housing is unfolded away from the underside of the table top;

wherein the wire management arrangement of the leg and the wire management housing are configured and arranged relative to each other to enable the cover of the wire management arrangement and the access member of the wire management housing to both be in the open position at the same time, to provide lay-in placement of wires into the wire-receiving recess of the leg and the internal cavity of the wire management housing.

15. The table assembly of claim 14, wherein the panel member is interconnected with a cross brace member which is engageable with each of a pair of the legs for bracing the legs against lateral movement, wherein the access member is pivotably mounted to the cross brace member.

16. The table assembly of claim 15, wherein each leg is pivotably mounted relative to the table top for movement between an inoperative folded position and an operative extended position, and further comprising a releasable engagement arrangement interposed between the cross brace member and each leg for releasably engaging the cross brace member with each leg when the legs are in the operative extended position and the wire management housing is in the operative extended position, wherein the releasable engagement arrangement is interconnected with each leg at a location spaced from the wire-receiving recess of each leg.

17. The table assembly of claim 16, wherein the access member is movably mounted to the cross brace member for movement between an open position providing access to the internal cavity of the wire management housing when the wire management housing is in its operative extended position, and a closed position for preventing access to the internal cavity, and is further movable to a collapsed position when the wire management housing is moved to its inoperative folded position against the underside of the table top, for reducing the volume of the internal cavity relative to the volume of the internal cavity when the access member is in its closed position, to prevent interference of the wire management housing with the legs when the legs are moved to their inoperative folded position.

18. A table assembly, comprising:

a table top;

a pair of legs pivotably mounted to an underside defined by the table top for movement between an inoperative folded position and an operative extended position; and wire management structure pivotably mounted relative to the table top for movement between an inoperative folded position and an operative extended position, wherein the wire management structure defines an internal cavity and includes a movable access panel extending throughout its length and movable between an open position and a closed position when the wire management structure is in its operative extended position to selectively provide and prevent access to the internal cavity, and wherein the access panel is further movable to a collapsed position when the wire management structure is in its inoperative folded position, wherein the access panel in its collapsed position is operable to reduce the volume of the internal cavity relative to the volume of the internal cavity when the access panel is in its closed position, to avoid interference of the wire management structure with the legs when the legs are moved to their inoperative folded position.

19. The table assembly of claim 18, wherein each leg includes an upper mounting portion rigidly secured to the underside of the table top, and a lower portion movably mounted to the upper mounting portion by means of a pivot connection which provides movement of each leg between its inoperative folded position and its operative extended position.

20. The table assembly of claim 19, wherein the wire management structure includes a wall which is pivotable relative to the table top for providing movement of the wire management structure between its inoperative folded position and its operative extended position, wherein the movable access panel is pivotable relative to the wall between its open position, its closed position and its collapsed position.

21. The table assembly of claim 20, wherein the wall is interconnected with a rigid cross-member spaced below the underside of the table top when the wire management structure is in its operative extended position, and further comprising a releasable engagement arrangement interposed between the rigid cross-member and each leg for bracing the legs against movement toward their inoperative folded position when the wire management structure is in its operative extended position.

22. The table assembly of claim 21, wherein the movable access panel of the wire management structure is pivotably mounted to the rigid cross-member for movement between its open position, its closed position and its collapsed position.

23. The table assembly of claim 19, wherein the upper mounting portion of each leg terminates in a lower end at the pivot connection between the lower portion and the upper mounting portion of each leg, and wherein the access panel in its collapsed position configures the wire management structure so as to be entirely disposed within a space below the underside of the table top located above the lower end of the upper mounting portions of the legs.

24. The table assembly of claim 19, wherein the lower portion of each leg includes a wire-receiving recess in communication with the internal cavity of the wire management structure when the wire management structure and the leg are each in the operative extended position, and further comprising a cover mounted to the lower portion of each leg for providing selective access to the wire-receiving recess.

25. The table assembly of claim 24, wherein the legs and the wire management structure are configured and arranged relative to each other such that the cover and the movable access panel of the wire management structure are both capable of being in an open position at the same time, to provide lay-in placement of wires within the wire-receiving recess of the leg internal cavity defined by the wire management structure.

26. A table assembly, comprising:

a table top;

a pair of foldable legs mounted to an underside defined by the table top for pivoting movement between an inoperative folded position and an operative extended position; and a wire management housing pivotably mounted below the table top and located between the legs, wherein the wire management housing is pivotably mounted by means of a pivot connection providing movement of the wire management housing between an inoperative folded position in which the wire management housing is folded against the underside of the table top, and an operative extended position in which the wire management housing is unfolded away from the underside of the table top, wherein the wire management housing includes a pair of end frame members, each of which defines an inner end located adjacent the underside of the table top and an outer end spaced from the inner end, and a structural cross-member connected between the end frame members toward the outer ends of the end frame members, wherein the structural cross-member is releasably engageable with the legs at a location spaced from the underside of the table top when the legs are in the operative extended position and the wire management housing is in the operative extended position, to provide a brace against movement of the legs away from the operative extended postion.

27. The table assembly of claim 26, wherein the wire management housing defines an internal cavity and includes an access member movably mounted to the structural cross-member for movement between an open position providing access to the internal cavity and a closed position preventing access to the internal cavity.

28. The table assembly of claim 27, wherein the access member is pivotably mounted to the structural cross-member for movement between its open and closed position.

29. A table assembly, comprising:

a table top;

a pair of foldable legs mounted to an underside defined by the table top for pivoting movement between an inoperative folded position and an operative extended position; and a wire management housing mounted below the underside of the table top and located between the legs, wherein the wire management housing is mounted to the table top by means of a pivot connection providing movement of the wire management housing between an inoperative folded position in which the wire management housing is folded against the underside of the table top, and an operative extended position in which the wire management housing is unfolded away from the underside of the table top, wherein the wire management housing includes a structural cross-member releasably engageable with the legs when the legs are in the operative extended position and the wire management housing is in the operative extended position, to provide a brace against movement of the legs away from the operative extended position, wherein the wire management housing defines an internal cavity and includes an access member movably mounted to the structural cross-member for movement between an open position providing access to the internal cavity and a closed position preventing access to the internal cavity, wherein the access member is pivotably mounted to the structural cross-member for movement between its open and closed positions;

wherein the structural cross-member comprises a rod member defining a generally circular outer surface and an outward protrusion, wherein the access member is pivotably mounted to the structural cross-member by means of clamping structure provided on the access member for clamping the rod member, wherein the clamping structure defines an end engageable with the protrusion for maintaining the access member in its closed position, and wherein the clamping structure is resiliently movable over the protrusion upon application of an outward force on the access member to pivot the access member to its open position, and wherein the clamping structure is capable of returning to its original condition upon return of the access member to its closed position for engaging the protrusion and maintaining the access member in its closed position.

30. The table assembly of claim 29, wherein the clamping structure is further movable over the protrusion upon application of an inward force to the access member when the wire management housing is in its inoperative folded position, so as to provide movement of the access member to a collapsed position to reduce the volume of the internal cavity for accommodating movement of the legs to the inoperative folded position.

31. The table assembly of claim 28, wherein the wire management housing includes a panel member and wherein the wire management housing is pivotably mounted below the table top by means of a pivot connection interposed between the underside of the table top and an upper end defined by the panel member, wherein the panel member is adapted for engagement with the underside of the table top when the wire management housing is in its inoperative folded position.

32. The table assembly of claim 31, wherein the structural cross-member is releasably engageable with the legs by means of an extendible and retractable engagement member mounted to each of a pair of spaced ends defined by the structural cross-member, wherein each extendible and retractable engagement member is engageable within a receiver associated with one of the legs when the legs are in the extended operative position and the wire management housing is in the operative extended position.

33. The table assembly of claim 32, wherein each extendible and retractable engagement member is biased outwardly toward an extended position relative to the structural cross-member, and wherein each leg includes ramp structure adjacent the receiver for moving the engagement member away from its extended position as the wire management housing is moved toward its operative extended position, wherein the receiver includes a recess and wherein the outward biasing of the engagement member functions to move the engagement member into the recess when the wire management housing reaches its operative extended position.

34. A table assembly, comprising:

a table top;

a pair of spaced, foldable legs interconnected with the table top for supporting the table top above a supporting surface, wherein each leg is movable relative to the table top between an inoperative folded position and an operative unfolded position;

a structural cross-member movably mounted below the table top, wherein the structural cross-member includes a releasable engagement arrangement adapted for engagement with the pair of legs for maintaining the legs in their operative unfolded positions, wherein the structural cross-member is spaced below an underside defined by the table top when the structural cross-member is engaged with the pair of legs; and a wire management housing movably mounted below the table top, wherein the wire management housing defines an internal cavity and includes an access member pivotably mounted to the structural cross-member for movement between an open position for providing access to the internal cavity for placing wires within the internal cavity, and a closed position for preventing access to the internal cavity and maintaining wires within the internal cavity.

35. The table assembly of claim 34, wherein the structural cross-member forms a part of the wire management housing, wherein the structural cross-member and the wire management housing are movable between an operative extended position wherein the structural cross-member is engaged with the leg structure, and an inoperative folded position wherein the wire management housing and the structural cross-member are moved toward the underside of the table top away from the leg structure for enabling the leg structure to be moved to its inoperative folded position.

36. The table assembly of claim 35, wherein the wire management housing includes a panel member pivotably mounted below the underside of the table top, and wherein the structural cross-member is mounted to and movable with the panel member.

37. A table assembly, comprising:

a table top;

leg structure for supporting the table top above a supporting surface;

a structural cross-member interconnected with the leg structure and spaced below an underside defined by the table top;

wherein the leg structure is foldable relative to the table assembly between an operative extended position and an inoperative folded position, and wherein the structural cross-member is releasably engageable with the leg structure when in its operative extended position so as to be disengageable from the leg structure to enable the leg structure to be moved to its inoperative folded position;

a wire management housing located below the table top, wherein the wire management housing defines an internal cavity and includes an access member pivotably mounted to the structural cross-member for movement between an open position for providing access to the internal cavity for placing wires within the internal cavity, and a closed position for preventing access to the internal cavity and maintaining wires within the internal cavity;

wherein the structural cross-member is mounted to the wire management housing, wherein the structural cross-member and the wire management housing are movable between an operative extended position for providing engagement of the structural cross-member with the leg structure, and an inoperative folded position in which the wire management housing and the structural cross-member are moved toward the underside of the table top away from the leg structure for enabling the leg structure to be moved to its inoperative folded position;

wherein the wire management housing includes a panel member pivotably mounted relative to the underside of the table top, and wherein the structural cross-member is mounted to and movable with the panel member; and wherein the access member is pivotable relative to the structural crossmember to a collapsed position when the wire management housing is in its inoperative folded position, for reducing the volume of the internal cavity when the wire management housing is in its inoperative folded position relative to the volume of the internal cavity when the wire management housing is in its operative extended position and the access member is in its closed position.

38. A table assembly, comprising:

a table top;

a pair of legs pivotably mounted to an underside of the table top for movement between an inoperative folded position and an operative extended position;

wire management structure located between the pair of legs, comprising a panel member pivotably mounted below the underside of the table top; a cross brace member mounted to the panel member; and an access member pivotably mounted to the cross brace member; wherein the pivotable mounting of the panel member below the table top provides movement of the wire management structure between an inoperative folded position and an operative extended position, wherein the cross brace member is spaced below the underside of the table top when the wire management structure is in its operative extended position, and wherein the panel member and the access member cooperate to define an internal cavity when the wire management structure is in its operative extended position for receiving wires therewithin; and a releasable engagement arrangement interposed between the legs and the cross brace member for engaging the cross brace member with the legs when the legs and the wire management structure are in their operative extended positions, wherein the cross brace member extends between the legs at a location spaced below the underside of the table top for bracing the legs against movement away from the operative extended position, and wherein the releasable engagement arrangement provides disengagement of the cross brace member from the legs to enable the legs and the wire management structure to be moved to their inoperative folded positions.

39. The table assembly of claim 38, wherein each leg includes a stationary upper mounting portion terminating in a lower end, and a lower portion pivotably interconnected with the upper mounting portion at the lower end of the upper mounting portion, and wherein the cross brace member extends between and is interconnected with the leg lower portions at a location below the upper mounting portions, when the wire management structure is in the operative extended position and the cross brace member is engaged with the legs.

40. A table assembly, comprising:

a table top;

a pair of legs pivotably mounted to an underside of the table top for movement between an inoperative folded position and an operative extended position, wherein each leg includes a stationary upper mounting portion terminating in a lower end, and a lower portion pivotably interconnected with the upper mounting portion at the lower end of the upper mounting portion;

wire management structure located between the pair of legs, comprising a panel member pivotably interconnected below the table top; a brace member mounted to the panel member; and an access member pivotably mounted to the brace member; wherein pivotable interconnection of the panel member below the table top provides movement of the wire management structure between an inoperative folded position and an operative extended position, and wherein the panel member and the access member cooperate to define an internal cavity when the wire management structure is in its operative extended position for receiving wires therewithin, wherein the access member is pivotable to a collapsed position when the wire management structure is in its inoperative folded position, wherein the access member in its collapsed position functions to configure the wire management structure so as to be received within a space defined between the underside of the table top and the lower end of the upper mounting portions of the legs; and a releasable engagement arrangement interposed between the legs and the brace member for engaging the brace member with the legs when the legs and the wire management structure are in their operative extended positions for bracing the legs against movement away from the operative extended position, wherein the releasable engagement arrangement provides disengagement of the brace member from the legs to enable the legs and the wire management structure to be moved to their inoperative folded positions.

41. A table assembly, comprising:

a table top:

a pair of legs pivotably mounted to an underside of the table top for movement between an inoperative folded position and an operative extended position;

wire management structure located between the pair of legs, comprising a panel member pivotably interconnected below the table top; a brace member mounted to the panel member; and an access member pivotably mounted to the brace member; wherein pivotable interconnection of the panel member below the table top provides movement of the wire management structure between an inoperative folded position and an operative extended position, and wherein the panel member and the access member cooperate to define an internal cavity when the wire management structure is in its operative extended position for receiving wires therewithin, wherein the brace member comprises a rod and wherein the access member includes an engagement end mounted to the rod for providing pivoting movement of the access member relative to the rod; and a releasable engagement arrangement interposed between the legs and the brace member for engaging the brace member with the legs when the legs and the wire management structure are in their operative extended positions for bracing the legs against movement away from the operative extended position, wherein the releasable engagement arrangement provides disengagement of the brace member from the legs to enable the legs and the wire management structure to be moved to their inoperative folded positions.

42. The table assembly of claim 41, wherein the engagement end of the access member defines an open passage within which the rod is received, wherein an opening to the passage is defined by a pair of spaced apart end areas defined by the engagement structure, wherein the rod defines a protrusion disposed within the space between the spaced apart end areas of the engagement end of the access member so as to releasably maintain the access member in its closed position, wherein the spaced end areas of the engagement end are movable over the protrusion upon application of either an inward force or an outward force to the access member for providing movement of the access member between its open position when the wire management structure is in its operative extended position, and a collapsed position when the wire management structure is in its inoperative folded position.

43. A table assembly, comprising:

a table top;

leg structure interconnected with the table top for supporting the table top above a supporting surface; and a wire management housing located below the table top, wherein the wire management housing includes a first wall section and a second wall section which cooperate to at least in part define an internal cavity; one or more electrical receptacles located within the internal cavity; wherein the first wall section is movable relative to the second wall section between an open position and a closed position for providing a first means for accessing the internal cavity from below the table top; and wherein the second wall section includes an opening in communication with the internal cavity for providing a second means for accessing the internal cavity from below the table top separate from the first means for accessing the internal cavity.

44. The table assembly of claim 43, wherein the first wall section comprises a rear access member and the second wall section comprises a front panel extending from the underside of the table top.

45. The table assembly of claim 44, wherein the leg structure comprises a pair of spaced legs, and wherein the front panel extends between the underside of the table top and a cross-member spaced below the underside of the table top wherein the cross-member extends between and interconnects the pair of legs.

46. The table assembly of claim 45, wherein the front panel defines a lower end spaced above the cross-member, and wherein the opening is defined between the cross-member and the lower end of the front panel.

47. The table assembly of claim 46, further comprising a resilient closure member mounted to the lower end of the front panel and including a lower end located adjacent the cross-member, wherein the lower end is selectively movable away from the cross-member to provide access to the internal cavity through the opening.

48. The table assembly of claim 46, wherein the front panel is pivotably mounted below the table top, for providing movement of the wire management housing between an operative extended position and an inoperative folded position, and wherein the pair of legs are pivotable between an operative extended position and an inoperative folded position in which the legs are folded over the wire management housing when the wire management housing is in its inoperative folded position, wherein the cross-member is engaged with the pair of legs when the legs are in the operative unfolded position to brace the legs against lateral movement.

49. The table assembly of claim 48, further comprising a releasable engagement arrangement interposed between the cross-member and legs for selectively engaging the cross-member with the legs when the wire management housing and the legs are in their operative extended positions.

50. The table assembly of claim 46, wherein the access member is pivotably mounted to the cross-member for movement between its open and closed positions.

51. A system for releasably engaging first and second adjacent table assemblies with each other, wherein the table assemblies include first and second table tops, respectively, each of which defines an edge and an underside, comprising:

a stationary engagement member located adjacent an edge of the first table top of the first table assembly and located below the underside of the first table top; and a movable latch member located adjacent the edge of the second table top of the second table assembly and located below the underside of the second table top, wherein the latch member is nonremovably mounted to the second table top for movement between an inoperative storage position in which the latch member is located inwardly of the edge of the second table top, and an operative latching position in which the latch member is movable outwardly of the edge of the second table top for releasable engagement with the stationary engagement member of the first table top for releasably engaging the first and second table assemblies together;

wherein the second table assembly includes leg structure located adjacent the edge of the second table top, wherein the leg structure defines an upper surface spaced below the underside of the table top, and wherein the latch member is located within a space defined between the underside of the table top and the upper surface defined by the leg structure.

52. The releasable engagement system of claim 51, wherein a table top mounting member extends between the upper surface of the leg structure and the underside of the table top for supporting the table top above the leg structure, and wherein the latch member is engaged with the mounting member for nonremovably mounting the latch member to the second table top.

53. The releasable engagement system of claim 52, wherein the first table assembly includes leg structure defining an upper surface spaced below the underside of the first table top and a mounting member extending between the underside of the table top and the upper surface of the leg structure, and wherein the latch member is releasably engageable with the mounting member of the first table assembly.

54. The releasable engagement system of claim 53, wherein the first and second table assemblies each include a pair of mounting members located within the space defined between the underside of the table top and the upper surface of the leg structure, wherein a latch member is nonremovably mounted to each mounting member of the second table assembly, wherein each latch member of the second table assembly is releasably engageable with a mounting member of the first table assembly.

55. The releasable engagement system of claim 53, wherein the latch member is pivotably mounted to the mounting member for movement between its inoperative storage position and its operative latching position.

56. The releasable engagement system of claim 55, wherein the latch member defines a closed mounting end defining a passage through which the mounting member extends for providing pivoting movement of the latch member between its inoperative storage position and its operative latching position, and an open engagement end spaced from the closed mounting end for releasable engagement with the mounting member of the first table assembly.

57. The releasable engagement system of claim 56, wherein the latch member is movable between its inoperative storage position and its operative latching position in a plane substantially parallel to a plane defined by the underside of the table top.

58. The releasable engagement system of claim 51, wherein each of the first and second table assemblies includes a pair of leg structures which are pivotably movable between an operative extended position and inoperative folded position, and a wire management housing disposed between the pair of leg structures and mounted to the underside of the table top for movement between an operative extended position and an inoperative folded position.

* * * * *

UNITED STATES PATENT AND TRADEMARK OFFICE

CERTIFICATE OF CORRECTION

PATENT NO. : 6,415,723 B1
DATED : July 9, 2002
INVENTOR(S) : Andrew J. Kopish et al.

It is certified that error appears in the above-identified patent and that said Letters Patent is hereby corrected as shown below:

Title page,
Item [56], References Cited, U.S. PATENT DOCUMENTS, please add the following references:

| | | |
|---|---|---|
| -- 6,003,447 | 12/1999 | Cox et al |
| 5,971,509 | 10/1999 | Diemen et al |
| 5,971,508 | 10/1999 | Diemen et al |
| 5,957,062 | 9/1999 | Cox et al |
| 5,947,628 | 9/1999 | Hansen |
| 5,769,514 | 1/1998 | Brown et al |
| 5,560,302 | 10/1996 | Diffrient et al |
| 5,357,874 | 10/1994 | Palmer |
| 5,237,935 | 8/1993 | Newhouse et al |
| 5,231,562 | 7/1993 | Pierce et al |
| 5,154,126 | 10/1992 | Newhouse et al |
| 964,996 | 12/1999 | Matthes |
| | | |
| 2,130,877 | 10/1982 | UK --. |

Column 23,
Line 60, delete "crossmember" and substitute therefore -- cross-member --;

Column 25,
Line 19, after "top" delete ":" and substitute therefore -- ; --.

Signed and Sealed this

Eighteenth Day of November, 2003

JAMES E. ROGAN
*Director of the United States Patent and Trademark Office*